US006940481B2

(12) United States Patent
Konno et al.

(10) Patent No.: US 6,940,481 B2
(45) Date of Patent: Sep. 6, 2005

(54) LIQUID CRYSTAL DISPLAY APPARATUS

(75) Inventors: Akitoyo Konno, Hitachi (JP); Makoto Tsumura, Hitachi (JP); Tsunenori Yamamoto, Hitachi (JP); Ikuo Hiyama, Hitachinaka (JP); Yoshinori Aono, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 384 days.

(21) Appl. No.: 10/099,994

(22) Filed: Mar. 19, 2002

(65) Prior Publication Data

US 2003/0080932 A1 May 1, 2003

(30) Foreign Application Priority Data

Oct. 30, 2001 (JP) ..... 2001-331843

(51) Int. Cl.[7] ..... G09G 3/36

(52) U.S. Cl. ..... 345/96; 345/87; 345/89

(58) Field of Search ..... 345/74, 76, 78, 345/96, 204, 213, 208, 260, 87, 89, 589; 445/6; 315/169.1; 349/42

(56) References Cited

U.S. PATENT DOCUMENTS 6,195,076 B1 * 2/2001 Sakuragi et al. ..... 345/74.1
6,545,653 B1 * 4/2003 Takahara et al. ..... 345/87
6,704,066 B2 * 3/2004 Tsumura et al. ..... 349/42
6,704,067 B2 * 3/2004 Tsumura et al. ..... 349/42
6,743,066 B1 * 6/2004 Oguchi et al. ..... 445/6
2002/0005846 A1 * 1/2002 Hiroki et al. ..... 345/204
2002/0075216 A1 * 6/2002 Satake ..... 345/89
2002/0154104 A1 * 10/2002 Inoue et al. ..... 345/204
2003/0011614 A1 * 1/2003 Itoh et al. ..... 345/589
2003/0090448 A1 * 5/2003 Tsumura et al. ..... 345/87
2003/0169247 A1 * 9/2003 Kawabe et al. ..... 345/204
2003/0169379 A1 * 9/2003 Tsumura et al. ..... 349/42

FOREIGN PATENT DOCUMENTS

JP 11-237606 * 8/1999
JP 2000-293142 * 10/2000

OTHER PUBLICATIONS

T. Kurita, "Fundamental Deterioration of Picture Quality for Moving Images Displayed on LCDs and Methods for Improvement", vol. 24, No. 54, ISSN 1342–6893, Sep. 2000.

* cited by examiner

*Primary Examiner*—Vijay Shankar
*Assistant Examiner*—Prabodh Dharia
(74) *Attorney, Agent, or Firm*—Antonelli, Terry, Stout & Kraus, LLP

(57) ABSTRACT

A liquid crystal display apparatus which is adapted to divide one frame period into a preset writing period, a first writing period, a first holding period, a second writing period, and a second holding period, to be driven in this sequence. The first and second writing periods have reverse writing voltage polarities and the second writing period is set to be about ½ of the first writing period.

40 Claims, 34 Drawing Sheets

FIG.4A

| | FIRST COLUMN | SECOND COLUMN | THIRD COLUMN | FIFTH COLUMN | FOURTH COLUMN | SIXTH COLUMN | | b-1 COLUMN | b COLUMN |
|---|---|---|---|---|---|---|---|---|---|
| FIRST LINE | — | — | — | — | — | — | | — | — |
| | | | | | | | | | |
| n-3-TH LINE | — | — | — | — | — | — | | — | — |
| n-2-TH LINE | — | — | — | — | — | — | | — | — |
| n-1-TH LINE | — | — | — | — | — | — | | — | — |
| n-TH LINE | — | — | — | — | — | — | | — | — |
| n+1-TH LINE | — | — | — | — | — | — | | — | — |
| n+2-TH LINE | — | — | — | — | — | — | | — | — |
| n+3-TH LINE | — | — | — | — | — | — | | — | — |
| | | | | | | | | | |
| 2n-TH LINE | — | — | — | — | — | — | | — | — |

ODD FRAME

EVEN FRAME

| | | | | | | | | | |
|---|---|---|---|---|---|---|---|---|---|
| FIRST LINE | + | + | + | + | + | + | | + | + |
| | | | | | | | | | |
| n-3-TH LINE | + | + | + | + | + | + | | + | + |
| n-2-TH LINE | + | + | + | + | + | + | | + | + |
| n-1-TH LINE | + | + | + | + | + | + | | + | + |
| n-TH LINE | + | + | + | + | + | + | | + | + |
| n+1-TH LINE | + | + | + | + | + | + | | + | + |
| n+2-TH LINE | + | + | + | + | + | + | | + | + |
| n+3-TH LINE | + | + | + | + | + | + | | + | + |
| | | | | | | | | | |
| 2n-TH LINE | + | + | + | + | + | + | | + | + |

FIG.4B

| | FIRST COLUMN | SECOND COLUMN | THIRD COLUMN | FIFTH COLUMN | FOURTH COLUMN | SIXTH COLUMN | | b-1 COLUMN | b COLUMN |
|---|---|---|---|---|---|---|---|---|---|
| FIRST LINE | − | − | − | − | − | − | | − | − |
| | | | | | | | | | |
| n-3-TH LINE | − | − | − | − | − | − | | − | − |
| n-2-TH LINE | + | + | + | + | + | + | | + | + |
| n-1-TH LINE | − | − | − | − | − | − | | − | − |
| n-TH LINE | + | + | + | + | + | + | | + | + |
| n+1-TH LINE | − | − | − | − | − | − | | − | − |
| n+2-TH LINE | + | + | + | + | + | + | | + | + |
| n+3-TH LINE | − | − | − | − | − | − | | − | − |
| | | | | | | | | | |
| 2n-TH LINE | + | + | + | + | + | + | | + | + |

ODD FRAME

EVEN FRAME

| | | | | | | | | | |
|---|---|---|---|---|---|---|---|---|---|
| FIRST LINE | + | + | + | + | + | + | | + | + |
| | | | | | | | | | |
| n-3-TH LINE | + | + | + | + | + | + | | + | + |
| n-2-TH LINE | − | − | − | − | − | − | | − | − |
| n-1-TH LINE | + | + | + | + | + | + | | + | + |
| n-TH LINE | − | − | − | − | − | − | | − | − |
| n+1-TH LINE | + | + | + | + | + | + | | + | + |
| n+2-TH LINE | − | − | − | − | − | − | | − | − |
| n+3-TH LINE | + | + | + | + | + | + | | + | + |
| | | | | | | | | | |
| 2n-TH LINE | − | − | − | − | − | − | | − | − |

FIG.4C

| | FIRST COLUMN | SECOND COLUMN | THIRD COLUMN | FIFTH COLUMN | FOURTH COLUMN | SIXTH COLUMN | | b-1 COLUMN | b COLUMN |
|---|---|---|---|---|---|---|---|---|---|
| FIRST LINE | − | + | − | + | − | + | | − | + |
| | | | | | | | | | |
| a-3-TH LINE | − | + | − | + | − | + | | − | + |
| a-2-TH LINE | − | + | − | + | − | + | | − | + |
| a-1-TH LINE | − | + | − | + | − | + | | − | + |
| a-TH LINE | − | + | − | + | − | + | | − | + |
| a+1-TH LINE | − | + | − | + | − | + | | − | + |
| a+2-TH LINE | − | + | − | + | − | + | | − | + |
| a+3-TH LINE | − | + | − | + | − | + | | − | + |
| | | | | | | | | | |
| 2a-TH LINE | − | + | − | + | − | + | | − | + |

ODD FRAME

EVEN FRAME

| | | | | | | | | | |
|---|---|---|---|---|---|---|---|---|---|
| FIRST LINE | + | − | + | − | + | − | | + | − |
| | | | | | | | | | |
| a-3-TH LINE | + | − | + | − | + | − | | + | − |
| a-2-TH LINE | + | − | + | − | + | − | | + | − |
| a-1-TH LINE | + | − | + | − | + | − | | + | − |
| a-TH LINE | + | − | + | − | + | − | | + | − |
| a+1-TH LINE | + | − | + | − | + | − | | + | − |
| a+2-TH LINE | + | − | + | − | + | − | | + | − |
| a+3-TH LINE | + | − | + | − | + | − | | + | − |
| | | | | | | | | | |
| 2a-TH LINE | + | − | + | − | + | − | | + | − |

FIG.4D

| | FIRST COLUMN | SECOND COLUMN | THIRD COLUMN | FIFTH COLUMN | FOURTH COLUMN | SIXTH COLUMN | | b-1 COLUMN | b COLUMN |
|---|---|---|---|---|---|---|---|---|---|
| FIRST LINE | − | + | − | + | − | + | | − | + |
| | | | | | | | | | |
| n-3-TH LINE | − | + | − | + | − | + | | − | + |
| n-2-TH LINE | + | − | + | − | + | − | | + | − |
| n-1-TH LINE | − | + | − | + | − | + | | − | + |
| n-TH LINE | + | − | + | − | + | − | | + | − |
| n+1-TH LINE | − | + | − | + | − | + | | − | + |
| n+2-TH LINE | + | − | + | − | + | − | | + | − |
| n+3-TH LINE | − | + | − | + | − | + | | − | + |
| | | | | | | | | | |
| 2n-TH LINE | + | − | + | − | + | − | | + | − |

ODD FRAME

EVEN FRAME

| | | | | | | | | | |
|---|---|---|---|---|---|---|---|---|---|
| FIRST LINE | + | − | + | − | + | − | | + | − |
| | | | | | | | | | |
| n-3-TH LINE | + | − | + | − | + | − | | + | − |
| n-2-TH LINE | − | + | − | + | − | + | | − | + |
| n-1-TH LINE | + | − | + | − | + | − | | + | − |
| n-TH LINE | − | + | − | + | − | + | | − | + |
| n+1-TH LINE | + | − | + | − | + | − | | + | − |
| n+2-TH LINE | − | + | − | + | − | + | | − | + |
| n+3-TH LINE | + | − | + | − | + | − | | + | − |
| | | | | | | | | | |
| 2n-TH LINE | − | + | − | + | − | + | | − | + |

MEMORY ADDRESS AND WRITTEN IMAGE SIGNAL 112 115

| | | | | | | |
|---|---|---|---|---|---|---|
| M(1,1) | M(1,2) | M(1,3) | M(1,4) | M(1,5) | M(1,6) | M(1,b) |
| D(1,1) | D(1,2) | D(1,3) | D(1,4) | D(1,5) | D(1,6) | D(1,b) |
| M(2,1) | M(2,2) | M(2,3) | M(2,4) | M(2,5) | M(2,6) | M(2,b) |
| D(2,1) | D(2,2) | D(2,3) | D(2,4) | D(2,5) | D(2,6) | D(2,b) |
| M(n,1) | M(n,2) | M(n,3) | M(n,4) | M(n,5) | M(n,6) | M(n,b) |
| D(n,1) | D(n,2) | D(n,3) | D(n,4) | D(n,5) | D(n,6) | D(n,b) |
| M(n+1,1) | M(n+1,2) | M(n+1,3) | M(n+1,4) | M(n+1,5) | M(n+1,6) | M(n+1,b) |
| D(n+1,1) | D(n+1,2) | D(n+1,3) | D(n+1,4) | D(n+1,5) | D(n+1,6) | D(n+1,b) |
| M(n+2,1) | M(n+2,2) | M(n+2,3) | M(n+2,4) | M(n+2,5) | M(n+2,6) | M(n+2,b) |
| D(n+2,1) | D(n+2,2) | D(n+2,3) | D(n+2,4) | D(n+2,5) | D(n+2,6) | D(n+2,b) |
| M(2n,1) | M(2n,2) | M(2n,3) | M(2n,4) | M(2n,5) | M(2n,6) | M(2n,b) |
| D(2n,1) | D(2n,2) | D(2n,3) | D(2n,4) | D(2n,5) | D(2n,6) | D(2n,b) |

LIQUID CRYSTAL DISPLAY APPARATUS

BACKGROUND OF THE INVENTION

1. Field of the Invention

The present invention relates to a liquid crystal display apparatus and, more particularly, to a liquid crystal display apparatus suitably used for motion image displaying, and a method for driving the same.

2. Description of the Related Art

The liquid crystal display apparatus have widely been used as display units for mobile devices represented by desktop and notebook type personal computers, a portable telephone set and the like. Recently, with increased demands for smaller market space and lower consumption of power, attention has been focused on liquid crystal television as a replacement for a cathode ray tube (CRT). Compared with the display unit such as the CRT, the liquid crystal display apparatus exhibits more excellent performance including reductions in size, weight and consumption of power, an increase in definition and the like. In the case of a low-speed motion image, in which an object to be displayed moves slowly, display performance is substantially equal to that of the CRT. However, in the case of a high-speed motion image, in which an object quickly moves, for example a sports program, image blurring, a contrast reduction slightly lowering image definition, and other problems occur.

For displaying of the liquid crystal display apparatus, in addition to a mainstream twisted nematic (TN) principle, in-plane switching (IPS) characterized by a wide angle of view, a multidomain vertical alignment (MVA) and the like have been used. In any case, an image is formed by making an illumination light from an illuminator (alias backlight) installed on the backside of the display unit incident on a liquid crystal panel capable of controlling a light transmissivity by rotating liquid crystal molecules according to an applied voltage. In such a conventional liquid crystal display apparatus, a cause of motion image blurring is considered to be a combination of a liquid crystal response speed and hold displaying common to the liquid crystal display apparatus and a plasma display apparatus. As the illuminator of the conventional liquid crystal display apparatus is always lit, when a displayed image is changed every moment as in the case of a motion image, a transient state of a transmissivity change before a sufficient optical response of a liquid crystal to written image data is also displayed. Consequently, a blurred image is detected by human eyes. In addition, in an always lit state of the illuminator, an image displayed in a given frame is held until a moment of next frame rewriting. Such a display system is called a hold display system. Blurring of a motion image caused by mismatching between the hold display system and human visual performance is described in pp. 13 to 18 of "Technical Report IDY 2000-147 of Institute of Image Information Media Engineers", September, 2000. This Report also describes a technology for intermittently light an illuminator to correct motion image blurring caused by a liquid crystal response or mismatching between the hold display system and the human visual performance. Specifically, it is described that a rate (lighting duty) of lighting the illuminator in a period of one frame affects a quality of a motion image, this lighting duty must be set equal to/lower than ½ when a motion image moved at a normal speed is displayed by using a high-speed response liquid crystal display (permissible limit of motion image blurring), and a detection limit, human eyes being unable to detect motion image blurring beyond this limit, is reached when the lighting duty is lowered to about ¼.

A level of improvement of the motion image with respect to the lighting duty depends on a moving speed of the motion image. Studies by the inventors et al have revealed that in the case of a low-speed image, a good motion image below the detection limit can be obtained even at a lighting duty of about ½. Moreover, Japanese Patent A-2000-293142 discloses a technology for improving motion image display performance of a liquid crystal display apparatus by intermittently lighting an illuminator.

To display an image by intermittent lighting of the illuminator, it is necessary to separate a scanning period for writing image data in the image from a lighting period of the illuminator. That is, the illuminator is basically lit after completion of an optical response of a liquid crystal corresponding to the image data written during scanning.

FIGS. 2A and 2B are explanatory views clarifying problems inherent in the liquid crystal display apparatus by intermittent lighting, assuming a case of black and white displaying on a full screen for each frame. FIG. 2A shows a display sequence, and optical responses of liquid crystals in a first line as an uppermost line, in an n-th line as a center line, and in a 2n-th line as a lowermost line on a screen in a light period 301. FIG. 2B shows a distribution of luminance in a longitudinal position when an image to be displayed white on a full screen is written. When a conventional scanning method for writing image data sequentially from an upper side to a lower side of the screen is used as shown in FIG. 2A, screen luminance is reduced from the upper side to the lower side of the screen as shown in FIG. 2B, and thus luminance inclination of the image is recognized.

Such luminance inclination occurs because of a writing operation of an active matrix, and intermittent light of the illuminator. Therefore, a displaying principle of a liquid crystal display apparatus of an active matrix type is now described.

A frame frequency of a typical liquid crystal display apparatus is 60 Hz, and one frame period is about 16.7 ms (milli-sec.). A phenomenon of reaching a corresponding light transmissivity after a voltage is applied to a liquid crystal is called an optical response of the liquid crystal, and a period from the voltage application to exhibition of the light transmissivity corresponding to the applied voltage by the liquid crystal is called an optical response period of the liquid crystal, normally indicating a time necessary for an optical response change from a transmissivity of 10% to 90% or 90% to 10%. Here, an example of a liquid crystal display material having an optical response characteristic of 8 ms. Scanning means selection of one line, and writing of image data in this line on all the screens. A period until an end of scanning is called a scanning period. A period of selecting one line, and writing image data of a pixel of this line is called a selection period. Writing of the image data in the pixel means application of a voltage to a liquid crystal carried out such that the liquid crystal can exhibit a desired transmissivity.

FIG. 3 shows an equivalent circuit of the active matrix liquid crystal display apparatus. At a starting time of the selection period, a potential for turning ON an active element 203 is applied to a line wiring 201 by a gate driver 196. A potential dependent on image data is applied to a column wiring 202 by a drain driver 107. A potential dependent on image data is applied to a pixel electrode 210 through the active element 203. A difference in potentials between the pixel electrode 210 and a common electrode 204 is charged to a liquid crystal 208 and a holding capacitor 205 connected in parallel. At an end time of the selection period, a potential for turning OFF the active element 203 is applied to the line wiring 201, completing the writing. The charging of the liquid crystal 208 and the holding capacitor 205 is finished within a very short time compared with an optical response of the liquid crystal. In this case, a light transmissivity exhibited by the liquid crystal 208 corresponds to an absolute value of an applied voltage, not dependent on polarity of the voltage.

Now, description is made of flickers and polarity of an applied voltage by referring to FIGS. 4A to 4D. It is generally known that liquid crystal property is deteriorated when a DC voltage is applied. In the case of image data supplied to a liquid crystal of a given pixel, normally, its polarity must be reversed at least for each frame. A transmissivity of the liquid crystal is decided by a size of an applied voltage, not dependent on its polarity. However, in the case of driving by using the active element, because of effects of parasitic capacitance of the active element or a leakage current in an OFF state of the active element, even if a potential is supplied from the data driver to apply a voltage of an equal size to the common electrode 204, slight deviation occurs in a value of a voltage actually applied to the liquid crystal. Consequently, because of a difference in luminance between positive and negative polarities even in the same image data, flickers are recognized at a frequency of about 60 Hz. For suppressing flickers, there are a method of increasing a frame frequency, and reversing positive and negative polarities at a frequency, at which human eyes cannot recognize a luminance difference between the positive and negative polarities, a method of preventing flickers from being recognized by human eyes by spatially dispersing pixels written at positive and negative polarities so as to average luminance differences, a method of using only a single polarity for displaying by lighting an illumination light source only at one of positive and negative polarities, at which writing is displayed. Conventionally, because of limited driving capabilities of the gate driver and the data driver, and in order to prevent a reduction in luminance caused by single polarity displaying, especially in the case of a large liquid crystal display apparatus, the method of spatially dispersing writing polarities has mainly been used. FIGS. 4A to 4D show polarities of image data written in pixels. Specifically, FIG. 4A shows a driving system for reversing polarities for each frame without spatially dispersing polarities of an applied voltage, which is called frame reversal driving; FIG. 4B a driving system for reversing polarities of an applied voltage for each line, and then reversing the polarities for each frame, which is called each-line reversal driving; FIG. 4C a driving system for reversing polarities of an applied voltage for each column, and then reversing the polarities for each frame, which is called each-column reversal driving; and FIG. 4D a driving system for reversing polarities of an applied voltage for each line and column, and then reversing the polarities for each frame, which is called dot reversal driving.

The frame reversal driving shown in FIG. 4A is designed to write image data of similar polarities on a full screen surface, and advantageous in that a potential outputted by the data driver in a given frame can always bet set equal to that of a common electrode, and a low withstand pressure data driver cab be used by combining the system with a common AC driving system for changing a potential of the common electrode 204 according to a writing polarity. However, when polarities of a displayed image made visible are simply reversed for each frame at a frame frequency of 60 Hz, flicker may be recognized because of a difference in writing characteristics between the positive and negative polarities.

In the cases of the each-line reversal driving shown in FIG. 4B and the each-column reversal driving shown in FIG. 4C, flickers can be prevented from being recognized by dispersing polarities of displayed images on screens, and averaging and displaying luminance differences caused by polarity differences to human eyes. In the case of the dot reversal driving shown in FIG. 4D, since polarities of a displayed image are reversed for each line, and then for each column, luminance differences caused by polarity differences are more averaged, thus preventing recognition of flickers.

When write scanning is performed from the upper side to the lower side of the screen as shown in FIG. 2A, writing is executed in the 1st line at the starting time of a scanning period; in the n-th line at the middle time of the scanning period; and in the 2n-th line at the end time of the starting period. Thus, since starting of liquid crystal optical response varies depending on a position within the screen, when the same image data is written on the full surface of the screen, a completion time of optical response also varies depending on a position in the screen. As shown in FIG. 2A, the process is carried out based on a sequence, where scanning is finished at a ½ frame, and the illuminator is lit in a ¼ frame period of a latter half. However, since image data is written in a pixel of the 1st line as an uppermost line of the screen at a starting time of the frame, liquid crystal optical response is completed with 8 ms from the frame starting time. On the other hand, image data is written in a pixel of the n-th line in the center of screen with 4 ms from the frame starting time; image data is written in a pixel of the 2n-th line in the lowermost side of the screen with 8 ms from the frame starting time; and each liquid crystal response is completed with 16 ms from the frame starting time. Here, as the illuminator is lit with 12 ms from the frame starting time, the liquid crystal optical response is completed in the pixel of the n-th line. But the liquid crystal optical response is not sufficiently completed in pixels of lines lower than the n-th. If the illuminator is lit in an uncompleted state of liquid crystal optical response, luminance is reduced in the case of white displaying, causing luminance inclination. FIG. 2B shows dependence of luminance inclination on a longitudinal position. In the foregoing, the optical response time of the liquid crystal was 8 ms, which was in the case of the liquid crystal having a relatively fast response speed. However, in a current liquid crystal display apparatus, an optical response time of a liquid crystal often exceeds even 20 ms. When a liquid crystal having such a slow response speed is used, a reduction may probably occur in luminance starting from the upper side of the screen, not from the center. For a TV image, a motion image appears in the vicinity of the screen in most cases, which is considered to be an area, where a view point of a viewer concentrates. Therefore, considering the view point concentration area of the viewer, when even slight luminance inclination occurs, luminance must be set highest in the vicinity of the center.

On the other hand, Japanese Patent A-11-237606 discloses a method of reversing upper and lower scanning directions for each field, in order to suppress luminance inclination dependent on a longitudinal position. However, since this method uses interlaced driving, when motion image data of one field is simply converted from field data into frame data, a DC component may be superimposed.

Furthermore, as methods for canceling an effect of display history of a previous frame, the above-described publication discloses a method of applying a preset voltage, and a method of applying positive and negative data signal voltages after application of a preset voltage.

FIG. 26 is an explanatory view showing a problem of properties when preset voltages are cyclically applied en block on the full surface of the screen according to the above-described method. In the drawing, writing voltages Vs1, Vsnm, and VS2n in the pixels of the 1st line in the uppermost layer, the n-th line in the center and the 2n-th line in the lowermost layer for two frames, and liquid crystal optical responses T1, Tn and T2n of the respective pixels are shown. In the line of the uppermost layer, since image data having a polarity reversed is written immediately after the application of a preset voltage, and at the middle time of the application of a next preset voltage, AC driving is achieved, where effective values of positive and negative voltages applied to the liquid crystal are equal to each other. However, rates of positive and negative voltage application time become more asymmetrical toward the lower side of the display area, and a DC voltage is effectively applied. In the lowermost layer, asymmetry becomes most conspicuous, bringing about one-side polarity driving. Consequently, it is difficult to suppress occurrence of flickers caused by superimposition of a DV voltage, and to achieve displaying of a motion image without any residual images. Therefore, there is a demand for an in-frame AC driving method for achieving liquid crystal AC driving in one frame irrespective of images or a displaying position in the panel.

In addition, a method may be employed, which apples preset voltages sequentially for lines in synchronization with scanning by dividing one frame into three parts, and setting a ⅓ frame as a resetting period. In this case, however, a certain writing operation is carried out during intermittent lighting of the illuminator, unfavorable crosstalk may be generated through a parasitic capacity between the line or column wiring and the pixel.

SUMMARY OF THE INVENTION

The present invention was made with the foregoing problems in mind, and an object of the invention is to provide an liquid crystal display apparatus adapted to execute intermittent lighting of an illuminator and application of a preset voltage in combination, and capable of performing high-definition displaying of a motion image without any residual images, flickers, crosstalk, or blurring.

Another object of the invention is to provide a liquid crystal display apparatus, which uses intermittent lighting of an illuminator, and has higher luminance toward a center of displaying, but no luminance differences in a boundary of scanning.

In order to achieve the above-described object, in accordance with the present invention, there is provided a driving method for a liquid crystal display apparatus, which includes a liquid crystal layer held between a pair of substrates, at least one thereof being transparent, a plurality of line wirings and a plurality of column wirings disposed on one of the substrates, and active elements in intersections of the pluralities of line and column wirings. The liquid crystal display apparatus displays an image by writing image data in pixels disposed in a matrix form through the active elements, executes reset writing on a full surface of a screen in synchronization with a frame signal, and makes the image visible by intermittently lighting an illuminator.

In the liquid crystal display apparatus of the invention for achieving the driving method, one frame period is divided into a first writing period, a first holding period, a second writing period, a second holding period, and a reset writing period. The liquid crystal display apparatus is driven in this sequence, and voltage polarities of the first and second writing periods are reversed. The second writing period is set to be about ½ of the first writing period.

Preferably, the first holding period is set to be substantially zero, and the second writing period is started after a passage of about ½ of a period obtained by subtracting a presetting period from one frame period. The second holding period and the lighting period of the illuminator are set substantially equal to each other, and a black-displaying potential is set for the column wiring at least in the light period of the illuminator. Thus, the object of the invention is most effectively achieved.

In order to achieve the other object, in accordance with the invention, there is provided a liquid crystal display apparatus, which includes a liquid crystal layer held between a pair of substrates, at least one thereof being transparent, a plurality of line wirings and a plurality of column wirings disposed on one of the substrates, and active elements in intersections of the pluralities of line and column wirings. The liquid crystal display apparatus displays an image by writing image data in pixels disposed in a matrix form through the active elements. Scanning is started from one line or a pair of adjacent lines, one or more lines being present in a screen, and the scanning is carried out in both upper and lower directions with the one line or the pair of adjacent lines set as a reference.

There is also provided an illuminator, which is adapted to make uniform luminance on a screen by canceling luminance inclination caused by response time of a liquid crystal with luminance inclination of the illuminator.

Furthermore, there is provided a method for optimally displaying motion and still images by switching driving of an illuminator between the motion and still images.

Other objects, features and advantages of the invention will become apparent from the following description of the embodiments of the invention taken in conjunction with the accompanying drawings.

BRIEF DESCRIPTION OF THE DRAWINGS

FIGS. 4A to 4D are views each showing a conventional AC driving method.

DESCRIPTION OF THE EMBODIMENTS

Next, specific description will be made of the embodiments of the present invention.

First Embodiment

Figure 1:
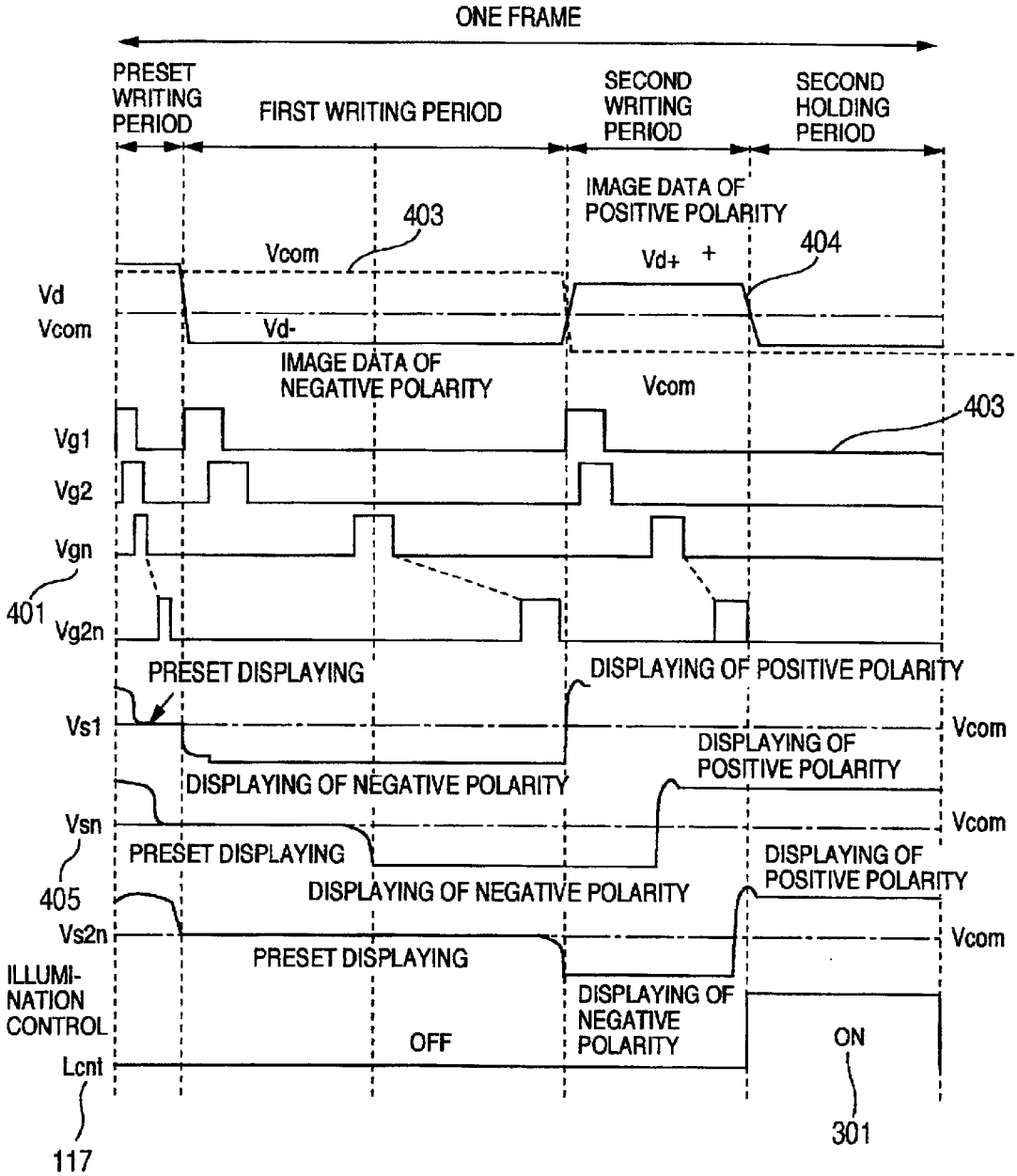
FIG. 1 is a view showing a driving sequence according to a first embodiment of the present invention.
Figure 2A:
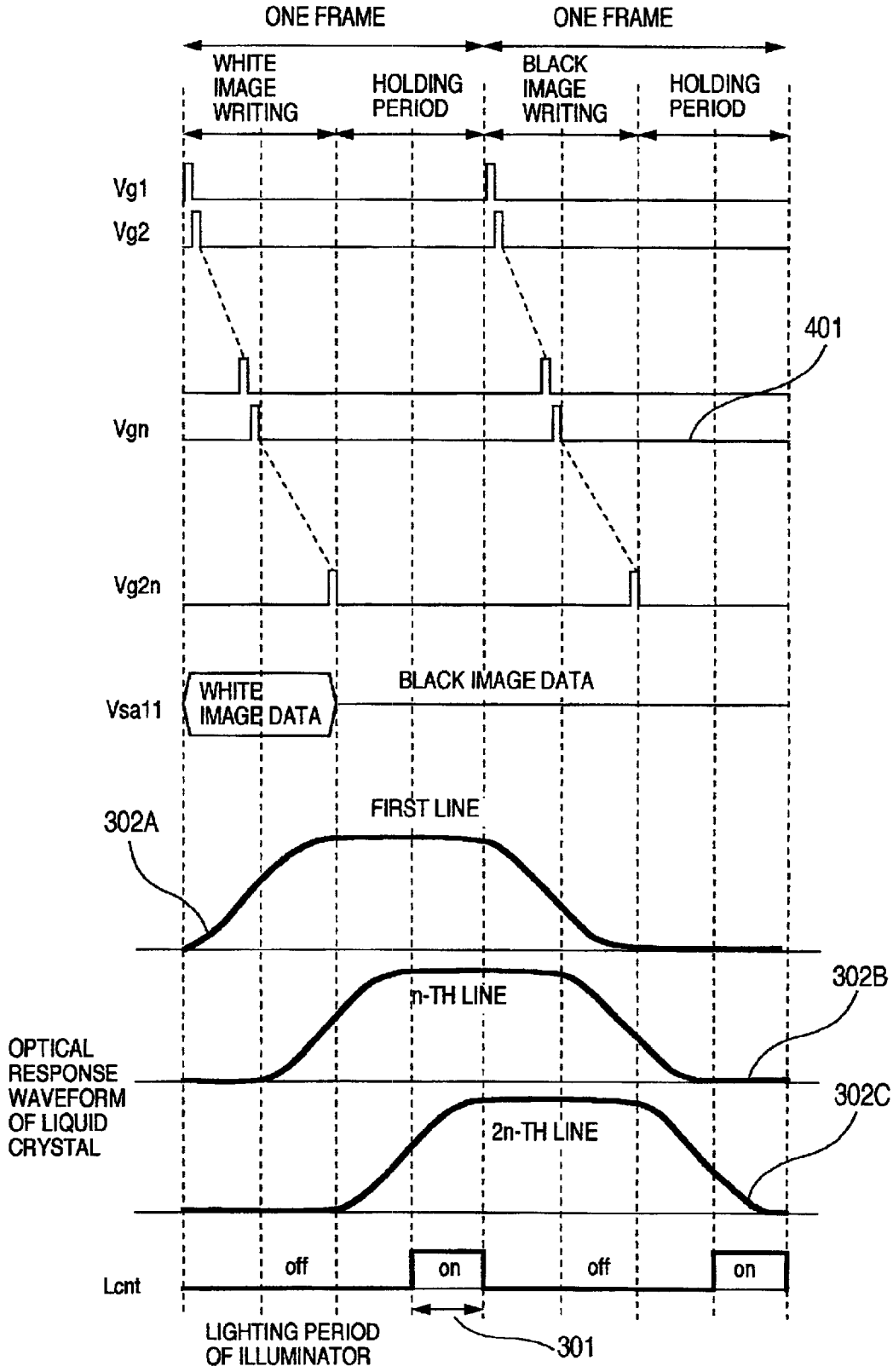
FIGS. 2A and 2B are views each showing a scanning method of a conventional system.
Figure 2B:
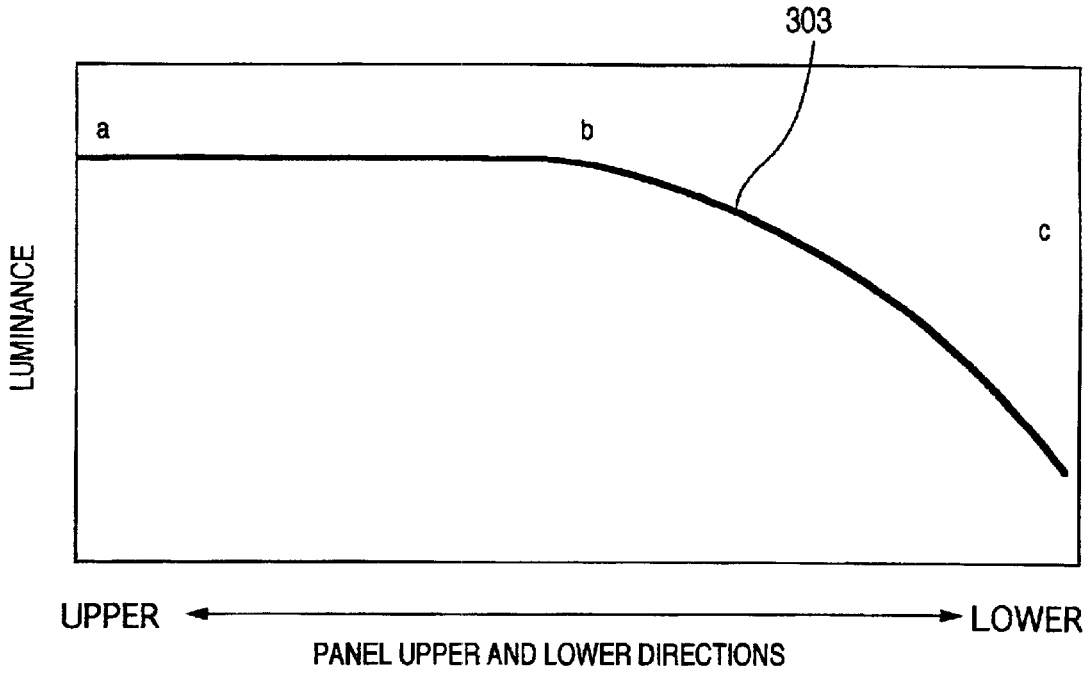
Figure 5:
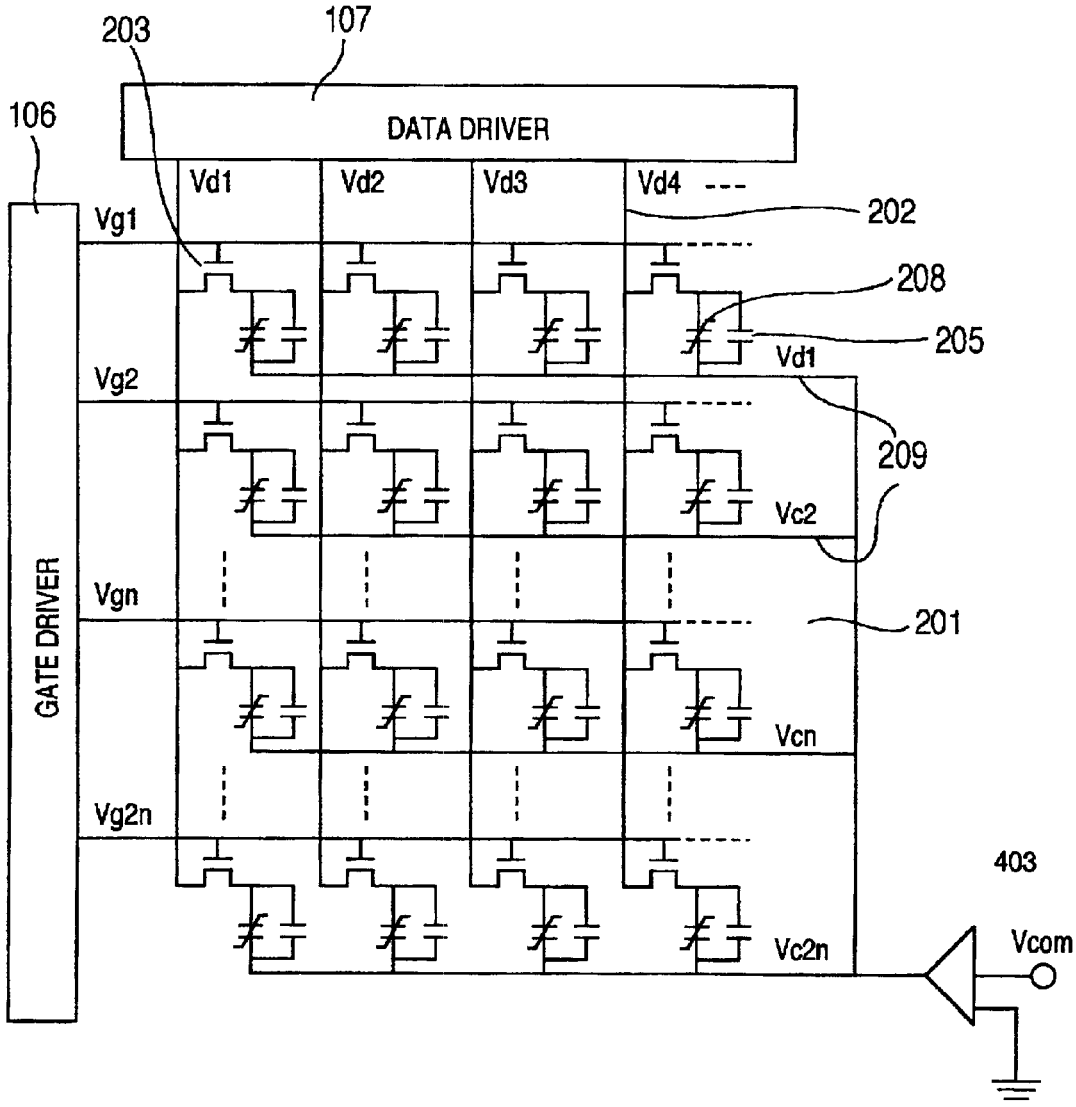
FIG. 5 is an equivalent circuit view of a liquid crystal display apparatus according to the first embodiment of the present invention.
Figure 6:
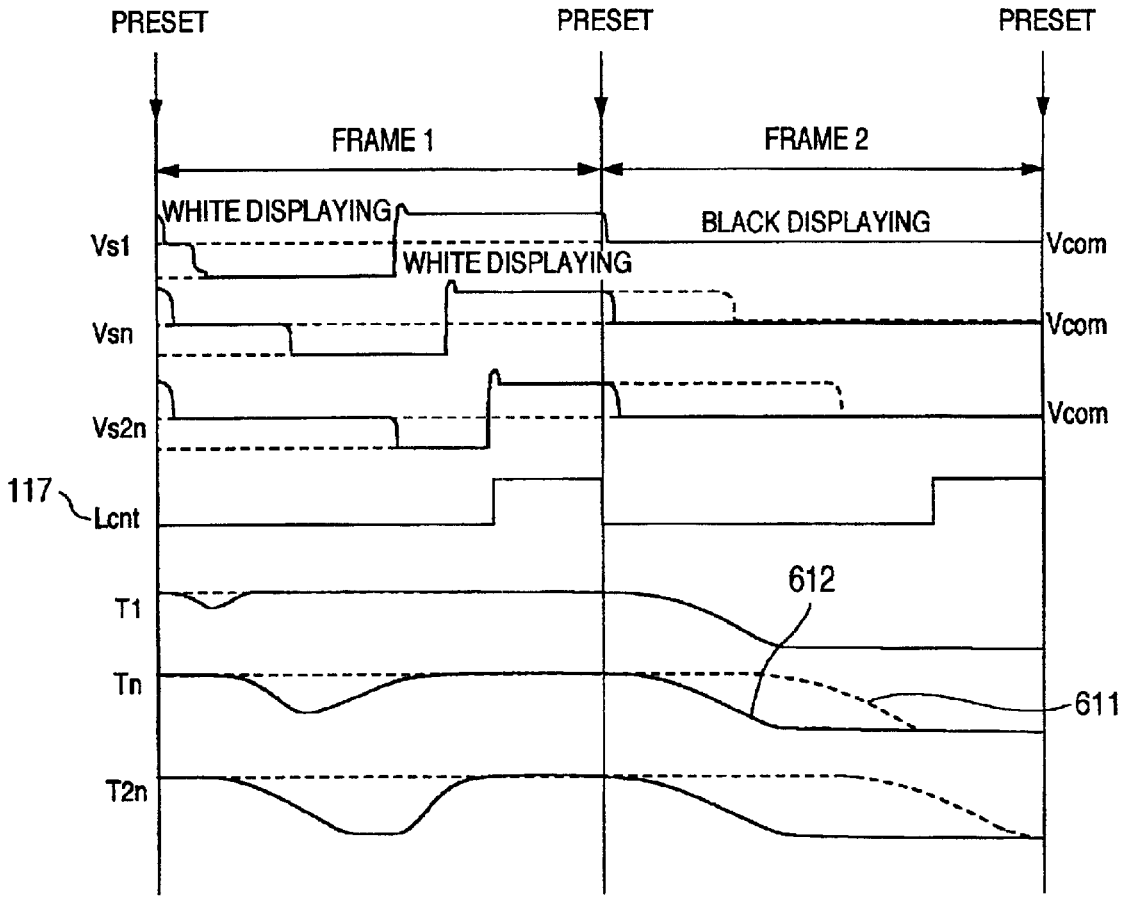
FIG. 6 is a view showing an advantage of the first embodiment of the invention.
Figure 7:
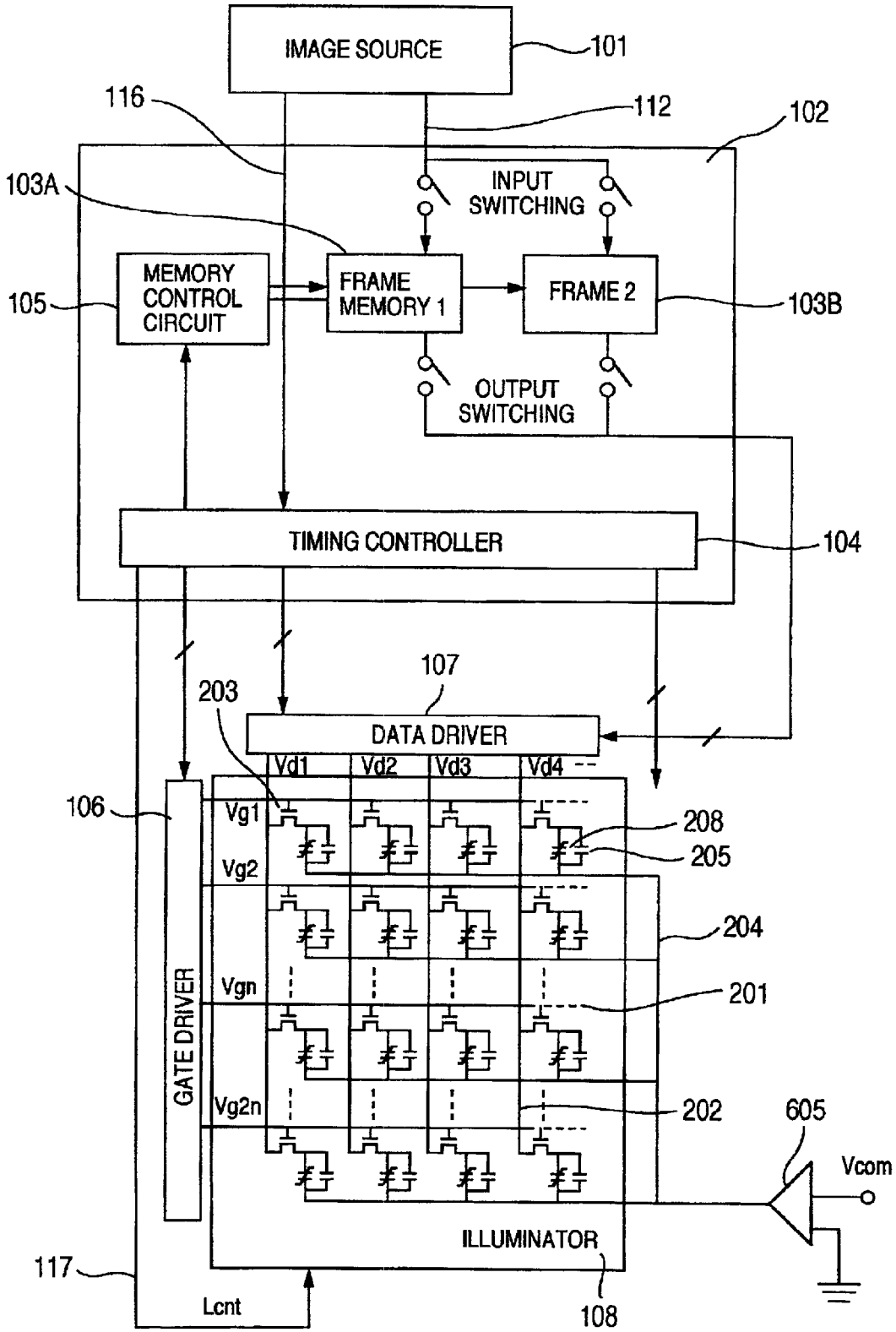
FIG. 7 is a system configuration view of the first embodiment of the invention.

Now, the first embodiment of the invention is described by referring to FIG. 1, and FIGS. 5 to 8, by way of example where a driving system of the invention is applied to a normally black in-plane switching mode for realizing black displaying when no voltage is applied, i.e., a voltage equal to/lower than a threshold value is applied. The embodiment is described by taking the example of the in-plane switching mode. However, it should be understood that the embodiment can be applied widely to liquid crystal display apparatus using an illumination optical system of TN and MVA modes or a projection type. FIG. 1 shows a driving sequence according to the first embodiment of the invention; FIG. 5 an equivalent circuit in a display unit of the liquid crystal display apparatus; FIG. 6 a comparative view of response characteristics in transfer to black displaying between presence and nonpresence of preset driving; FIG. 7 a system configuration view showing an entire configuration according to the embodiment; and FIG. 8 a driving sequence of a display control unit of the system.

Figure 3:
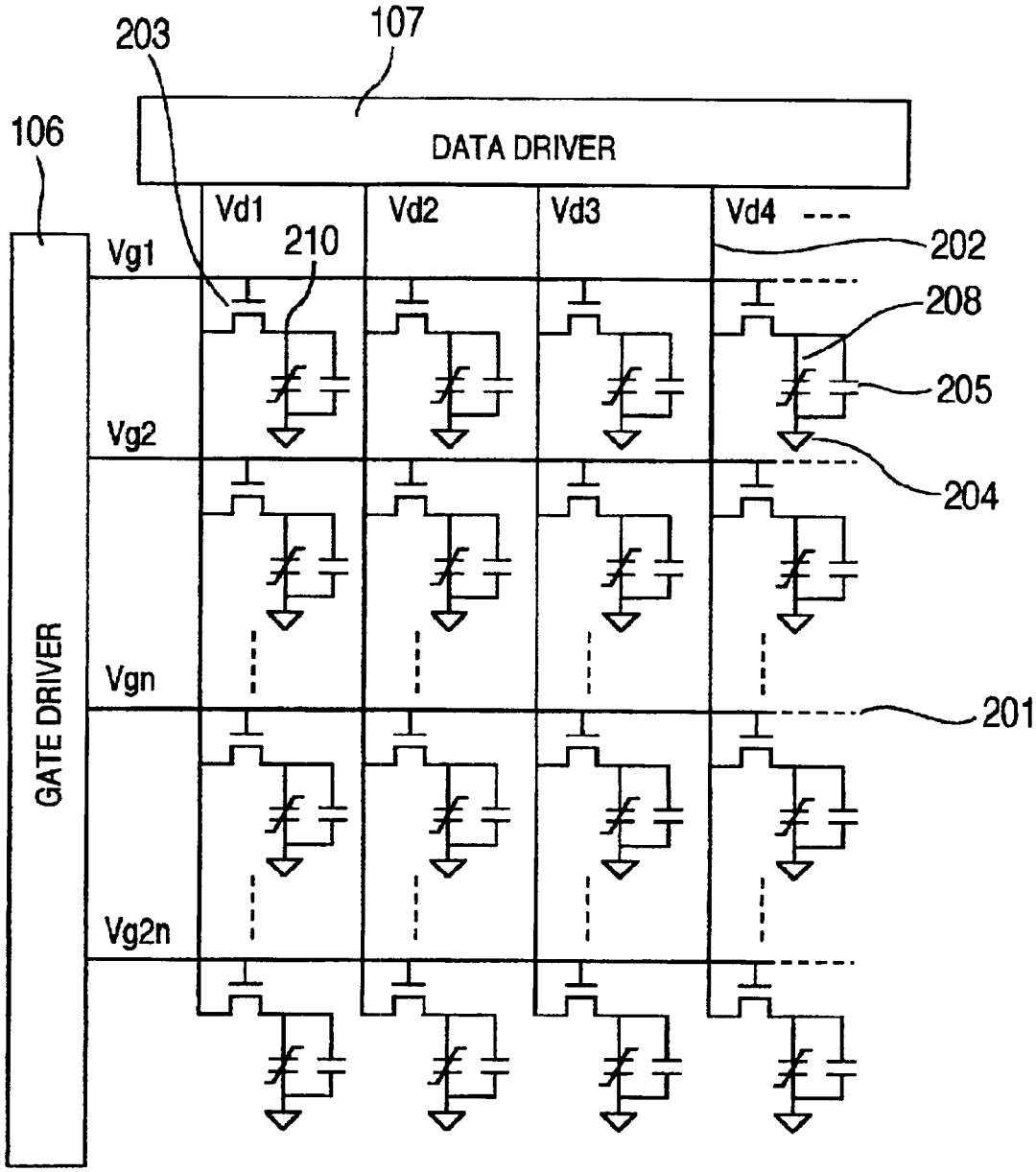
FIG. 3 is an equivalent circuit view of a liquid crystal display apparatus of the conventional system.

As shown in the equivalent circuit of the display unit of FIG. 5, a basic configuration is substantially similar to that of the conventional example of FIG. 3. Because of use of the in-plane switching mode, common wirings 209: Vc1 to Vc2n are dispose with other circuit components such as TFT 203 on the same substrate. Thus, the common wrings common among lines are extended in a line direction, and connected for ends, and a voltage is controlled by a variable power source using an operation amplifier. In the embodiment, the common wirings are extended in the line direction. However, the common wirings can be disposed in a meshed form in an entire display area so as to reduce resistance, or extended in a column direction to suppress a load current applied to the common wirings during writing, thereby reducing common wiring distortion caused by writing. The common wirings of embodiments in the in-plane switching mode, including the first embodiment, can be selected from the above-described configurations. Especially, in a frame common AC driving system for setting an AC potential in the common wirings for each frame, described in the embodiment, constraints on the common wirings are limited, and thus good characteristics are exhibited in all the above-described form of the common wirings. Here, for a scanning gate driver 106, one capable of setting an output in a high resistance state at time of unselection is used for the purpose of reducing a load on a drain driver 107. However, a function is completely similar even if a normal scanning gate driver is used. Other functions are similar to those of the conventional example, where scanning pulses are sequentially outputted. For the drain driver 107, one capable of making outputs of similar polarities from all output terminals is used. In the embodiment, since a low voltage of the drain driver is achieved by AC voltage of the common wirings for each frame (hereinafter, this driving system is referred to as a frame common AC driving system), maximum amplitude of an output voltage is about 7V. When AC voltage of the common wirings is not used, a driver having maximum amplitude of 13V to 15V is necessary.

Next, description is made of a driving sequence according to the invention by referring to FIG. 1. The drawing specifically shows the driving sequence of one frame period focusing on applied voltages and response waveforms thereof, and an image is displayed by repeating this sequence. As the applied voltages, image data Vd, a common electrode potential Vcom, respective gate wiring potentials from a gate wiring potential Vg1 of an uppermost stage, a gate wring potential Vgn of a screen center, to a ate wiring potential Vg2n of a lowermost stage, and a control signal Lcnt117 of an illuminator are shown. As response waveforms, those of pixel potentials Vs1 to Vs2n obtained from the driving sequence are shown. The image data Vd is described based on an example of uniform displaying. In practice, negative polarity image data $Vd^-$ and positive polarity image data $Vd^+$ each having voltage amplitude according to the image data are applied.

According to the driving system of the invention, first, black writing is executed for all the pixel electrodes irrespective of places on the screen by preset writing and, thereby, black display is assured especially in the case of a lower pixel, in which an image data writing timing is slow, and a contrast ratio is easily reduced. Particularly, on the normally black mode of the embodiment, when displaying is changed from white of high voltage application to black for releasing a voltage applied to the liquid crystal, no high-speed response means for accelerated voltage application or the like can be used. Thus, apparently, means for assuring black writing must be provided in combination with higher-speed response of the liquid crystal material by the invention. Then, AC driving in one frame is achieved in the first and second writing periods, and a backlight is lit by the illumination control signal Lcnt117 in the holding period. In the embodiment, a frequency of a writing clock signal in the first period is adjusted, and the writing operation is finished in a period of about ½ obtained by subtracting the preset writing period from one frame period. Thus, a first holding period is not present. Hereinafter, detailed description is made of each operation in the sequence.

In the case of the preset writing, in order to shorten an effective displaying period of positive and negative polarities as shown in the voltage waveform Vs1 of the uppermost stage, en-block writing of a very short time on a full surface of the screen is ideal. In practice, however, because of an increase in a power supply load of the gate driver or the like, high-speed writing by multiphase overlapped scanning is effective. In the embodiment, gate scanning of 768 lines is executed by about 400 micro-sec. by multiphase overlapped scanning for simultaneously selecting maximum 40 lines by writing time of 20 micro-sec. per line and using a clock frequency 2 MHz of the gate driver, and the preset writing is finished in a display return period.

Following the preset writing, image data of a negative polarity is written by using about ½ frame period. In this case, a writing period becomes about ½ of that in the conventional system of one writing for one frame. In the embodiment, however, writing polarities are set similar to one another on the full surface of the screen, the common electrode potential Vcom is maintained constant in the writing period of similar polarities, a gate selection period longer than normal is obtained by overlapping several adjacent lines as shown in respective gate wiring potential waveforms Vg1 to Vg2n, and setting "High level" indicating a gate selection state, and writing loads applied on the drain driver and the active element disposed in the pixel are greatly reduced. Thus, sufficient writing in the pixel can be achieved. Such application of a voltage to the pixel with several adjacent lines overlapped is called precharging.

Figure 20:
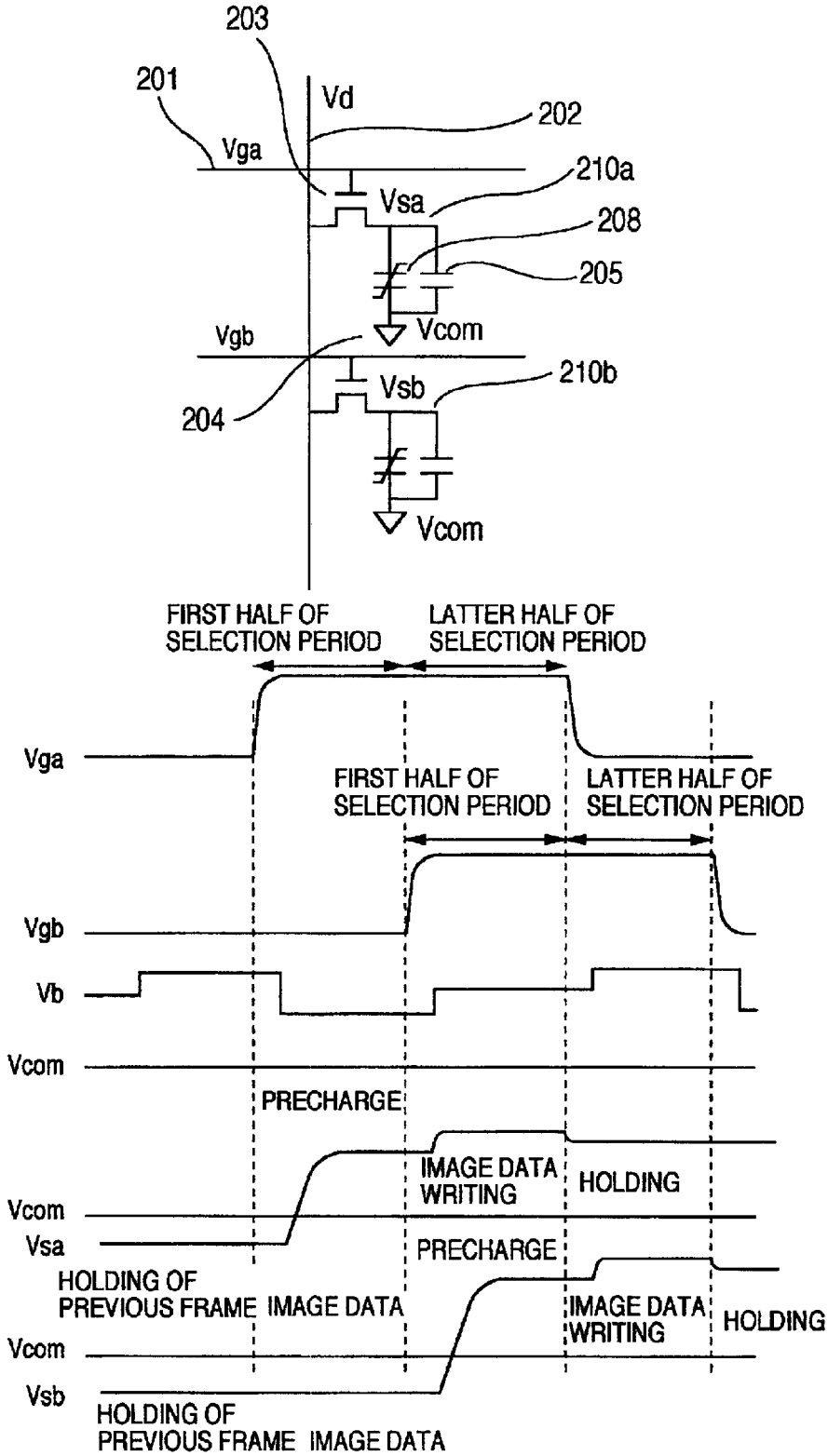
FIG. 20 is an explanatory view showing a precharging principle.

Now, an effect of precharging is described by referring to FIG. 20. First, by selecting a plurality of lines, an effect of charging delay generated by a capacitive load connected to the line wiring 201 and wiring resistance can be greatly reduced. Since wiring resistance in the embodiment is about 3 kΩ, and a wiring capacity is about 400 pF, a charging time constant $\tau$ is $\tau$=1.2 micro-sec. However, to obtain a sufficient writing characteristic, normally, a selection period 4 to 8 times longer is required. On the other hand, a selection time of the second writing period is about 5 micro-sec., when no precharging is used, and thus precharging is effectively operated. Next, a reduction in a writing load is described. When frame reversal or reversal for each column is used, image data written in pixels belonging to the same column in a given frame take similar polarities. Thus, by overlapping a selection period of a line selected one before, and by image data of lines selected one before or more, polarities to be written in the frame can be applied beforehand. Accordingly, writing of the image data is facilitated. FIG. 20 shows an example of a frame, where attention is paid to pixels of two lines in a given column, and image data of a positive plurality is written. First, in the case of the upper pixel, since image data of a previous frame is held before a selection period, a potential of a negative polarity is held in a pixel electrode Vsa210*a* with respect to the potential Vcom of the common electrode 204. Then, the selection period is started and, when a line wiring potential 401 Vga becomes high, an active element 203 is turned ON, a positive-polarity potential of a column wiring 202 is applied to a pixel electrode 210*a*, and the common electrode 204 is charged to a positive polarity in ½ of the first half of the selection period. In ½ of the latter half of the selection period, image data contributing to displaying is written by a positive polarity. At the end time of the selection period, a line wiring potential Vga becomes low, and the positive-polarity potential written in the common electrode 204 in ½ of the latter half of the selection period is held in the pixel electrode Vsa210*a*. In the case of the lower pixel, since image data of a previous frame is held before the selection period, a potential of a negative polarity is held in a pixel electrode Vsb with respect to the potential Vcom of the common electrode 204. Then, the selection period is started and, when a line wiring potential Vgb becomes high, the active element 203 is turned ON, a positive-polarity potential of the line wiring 202 is applied to the pixel electrode 210*a*, and the common electrode 204 is charged to a positive potential in ½ of the first half of the selection period. A positive-polarity potential applied to a pixel electrode 210*b* in this case is one applied in ½ of the first half of the selection period for the upper pixel. In ½ of the latter half of the selection period, image data contributing to displaying is written by a positive polarity. At the end of the selection period, a line wiring potential Vgb becomes low, and the positive-polarity potential written in the common electrode 204 in ½ of the latter half of the selection period is held in the pixel electrode 210*b*. Thus, by overlapping half of a selection period of a line selected one before with a selection period of a given line, a held reverse-polarity potential of a previous frame can be charged to a polarity of a current frame beforehand by image data written in a line one before, facilitating writing of image data contributing to displaying in ½ of the latter half of the selection period.

For writing of image data of a positive polarity, good writing conditions can be obtained substantially similarly. A difference from the case of the negative polarity is that a selection period of a column wiring by the drain driver is shorted by ½ and, in the positive polarity, i.e., in the first writing period, because of preset writing of a previous time, a black voltage has been written uniformly. However, for a charging time constant reduction of a column wiring, since a low-resistance material mainly containing aluminum is used for the column wiring, a charging time constant of the column wiring can be reduced to about 1 to 2 micro-sec., achieving a sufficient writing characteristic. An item to be easily recognized as deterioration of a displayed image may be a reduction in a contrast ratio caused by insufficient fixation of black in black displaying. By improving a black writing characteristic in the second writing period having a particularly large effect on displaying, a contrast ratio of an image made visible can be increased. In the frame common AC driving system used in the embodiment, a potential of a common electrode of a positive polarity is lower than that of a common electrode of a negative polarity and, accordingly, a black writing voltage of a positive polarity becomes lower than that of a negative polarity. A potential difference Vgh−Vdbk between a "High level" Vgh of the gate and a black writing voltage Vdbk of the drain electrode during black writing has a larger positive polarity. Thus, a potential difference Vgh−Vdbk2 of the second writing period is larger than a potential difference Vgh−Vbdk1 of the first writing period. In the second writing period having stricter writing conditions, in order to secure a high TFT writing capability, a positive polarity is selected in the second writing period to improve black writing characteristics.

In addition, by adjusting a precharging time in the second writing period as shown in FIG. 1, an effective selection period combined with a scanning selection period can be set substantially equal to an effective selection period of the first writing period. In this case, a voltage writing characteristic of the second writing period can be greatly improved.

In the described case, the selection time of the positive polarity writing, i.e., the second writing period, is set to ½ of that of the first writing period, in other words, a shift clock frequency of the gate driver is increased twice. However, since periods of positive-polarity displaying and negative-polarity displaying from a stating time of negative-polarity displaying to next present writing can be set equal to each other in all display areas, in-frame AC driving can be achieved in the embodiment of performing preset writing substantially simultaneously on the full surface of the screen. By the achievement of the in-frame AC driving, even in the case of high-speed motion image, it is possible to display a motion image having no residual images or tailing without any accumulation of DC components in the pixel.

A holding period for displaying an image by lighting the illuminator is set at a constant potential by stopping all circuit operations. Thus, crosstalk caused by capacitive coupling between a wiring and a pixel can be completed prevented. In the conventional liquid crystal display apparatus, when a square colored inside is displayed, crosstalk called a longitudinal smear may occur in a longitudinal direction. To suppress such crosstalk, reverse driving for each line or each pixel has frequency been used. According to the embodiment, since such reverse driving by a line unit is made unnecessary, it is possible to achieve high-speed writing.

In the embodiment, a common electrode potential Vcom of the holding period of is set to a voltage substantially equal to an output voltage Vd of the drain driver. Longitudinal smear can be completely suppressed by stopping all the circuit operations to set a constant potential. However, a voltage caused by a potential difference between a column wiring potential during positive polarity writing, and a column wiring potential of the holding period is superimposed on a pixel potential in the holding period. This voltage generates no longitudinal smear because of undependence on a pattern of a displayed image, but a voltage applied to the liquid crystal of a pixel is changed. In this case, fluctuation in a black writing voltage leads to a reduction in a contrast ratio. Thus, in the embodiment, in order to prevent an effect on black displaying, the common electrode potential Vcom of the holding period is set to a voltage substantially equal to the output voltage Vd of the drain driver.

Now, by referring to FIG. 6, description is made of an effect of the embodiment for liquid crystal response by way of example where displaying changed from white to black. FIG. 6 shows pixel voltages Vs1, Vsn and Vs2n of uppermost, middle and lowermost stages of two frames, and respective liquid crystal responses T1, Tn and T2n when luminance is indicated by an ordinate. In the drawing, a broken line indicates a characteristic with no presetting, and a solid line indicates a characteristic with presetting. It can understood from the drawing that there are almost no effects of the presence/nonpresence of presetting on the uppermost stage, but in the middle stages and after, with no presetting, response delay may reduce contrast.

In the embodiment, as an illuminator, a LED array to be operated ON/OFF at a high speed is used. Since the ON/OFF operation of the LED has response performance of 2 millisec., or lower, an illumination period substantially equal to that of an illumination control signal Lcn117. Accordingly, it is possible to make completely invisible a display state of the liquid crystal other than a lighting duty of a ¼ frame, in which quality deterioration of a motion image cannot be detected by human eyes. That is, the illuminator can be turned OFF before displaying is changed from black to white, which greatly affects display response of a liquid crystal in a next frame, especially contrast performance, making it possible to prevent a display state of the next frame from reducing contrast. On the other hand, for a change of displaying in a self-frame, according to the invention, black writing is carried out on the full surface of the screen by preset writing at the starting time of the frame. Thus, displaying having maximum contrast can be achieved. In the embodiment, the LED array sufficiently high in a response speed and easily available is used for the illuminator. However, any illuminators having high-speed responsiveness can be used.

Figure 8:
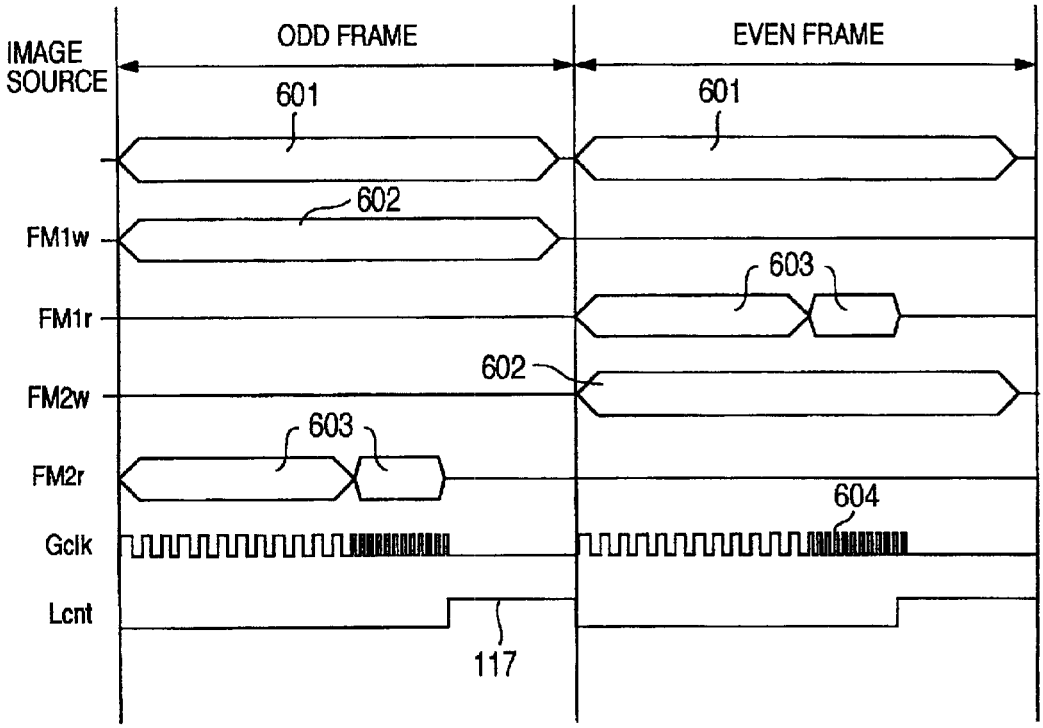
FIG. 8 is a view showing a sequence of a frame memory unit of the first embodiment of the invention.

FIG. 7 shows a system configuration of the display apparatus of the embodiment. FIG. 8 shows a sequence based on remote control of the system. Compared with the conventional system configuration, a difference is that an image memory of two frames is provided in order to achieve in-frame AC driving, and image data is transferred to a liquid crystal panel by an operation of an alternate buffer form. A feature in this case is that a frequency of a gate driver clock frequency in ½ of the latter half is increased twice from that in the ½ of the first half of one frame.

According to the embodiment, in the liquid crystal display apparatus for intermittently lighting the illuminator, and preset-driving the entire screen at the start of the frame, in-frame AC driving can be achieved in low-voltage driving by AC setting of the common electrode, and high-quality liquid crystal displaying having no longitudinal smear or residual motion images can be achieved.

Second Embodiment

Figure 9:
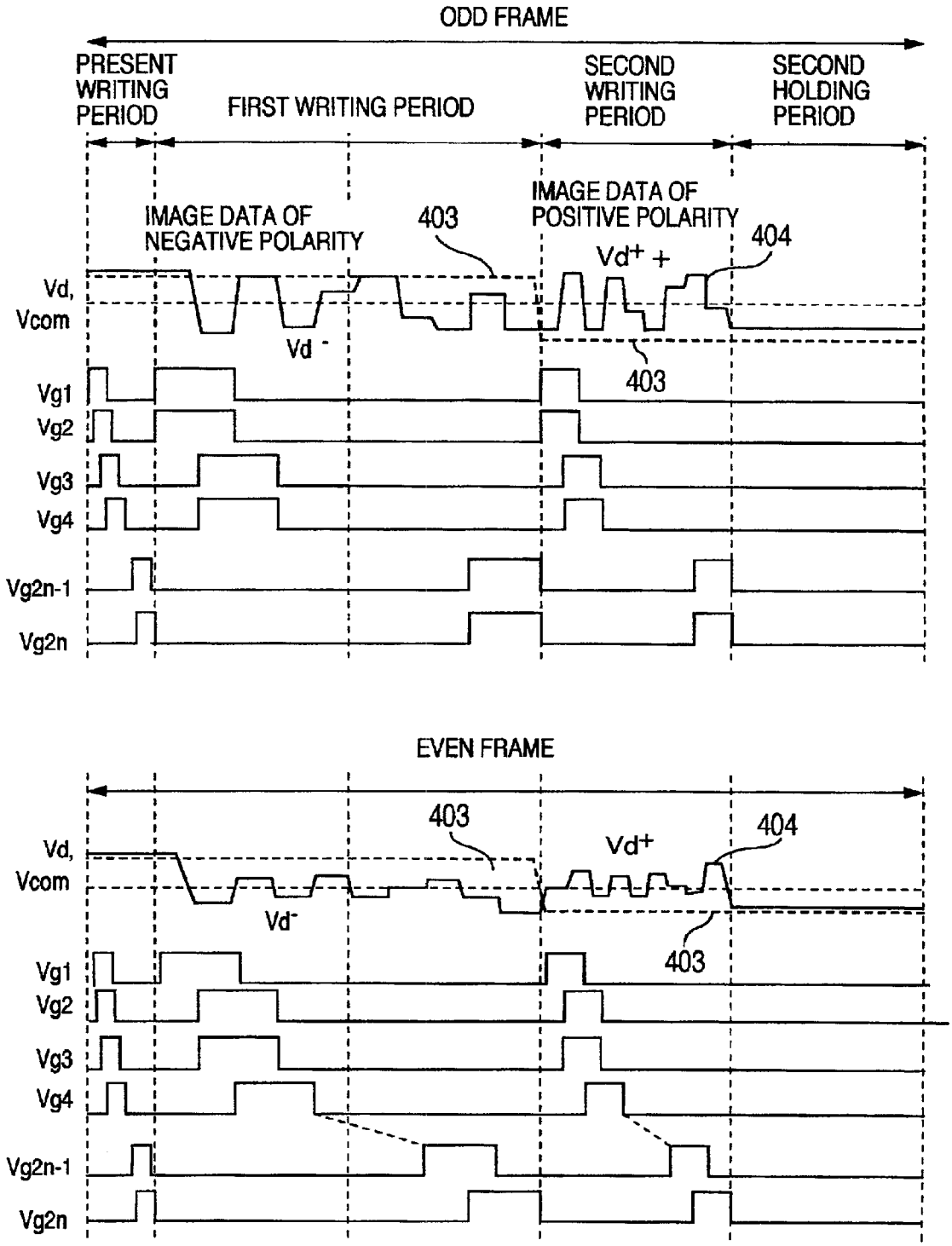
FIG. 9 is a view showing a driving sequence according to a second embodiment of the present invention.

Next, description is made of a second embodiment of the present invention by referring to FIG. 9. This embodiment is applied to a normally black in-plane switching mode as in the case of the first embodiment. The invention provides a display driving system suitable for interlaced driving generally used for broadcast image data or stored motion image data, and maintaining image definition high, and a display apparatus. FIG. 9 shows a driving sequence of main portions of the embodiment. A basic driving sequence is similar to that of the first embodiment. However, a method of transferring image data to the liquid crystal display apparatus corresponding to interlaced data, and a panel driving method according to this are different.

Display image data constructed based on interlaced driving specifications includes an odd field composed of image data of odd lines, and an even field composed of image data of even lines. When these interlaced image data are applied to a display of an interlaced driving type such as a liquid crystal display, as shown in FIG. 9, normally, a two-line simultaneous driving method for displaying the same data for every two lines is frequency used. In this case, two-line simultaneous driving is equivalent to conversion of image data of one field into image data of one frame. In the display apparatus using the two-line driving method, a combination of lines selected in the odd frame and the even frame is changed based on line information of original data as shown in FIG. 9. Thus, displaying of 79% definition of all the lines can be achieved by considering Kel factor. For example, in a liquid crystal display apparatus of 768 lines, image definition of 530 lines or more can be obtained by employing two-line simultaneous driving and a driving system for changing a line to be selected for each frame. Thus, definition equal to/higher than definition of current commercial broadcasting can be achieved.

A difference between a conventional two-line simultaneous driving method and that of the embodiment is that in the embodiment, since in-frame AC driving is a basis, AC setting of a liquid crystal is completed in a frame. Therefore, according to the embodiment, even for a motion image of any changes, without any superimposition of DC components on the liquid crystal, it is possible to prevent residual images or a burning phenomenon without devising image processing or the like.

Third Embodiment

Figure 10A:
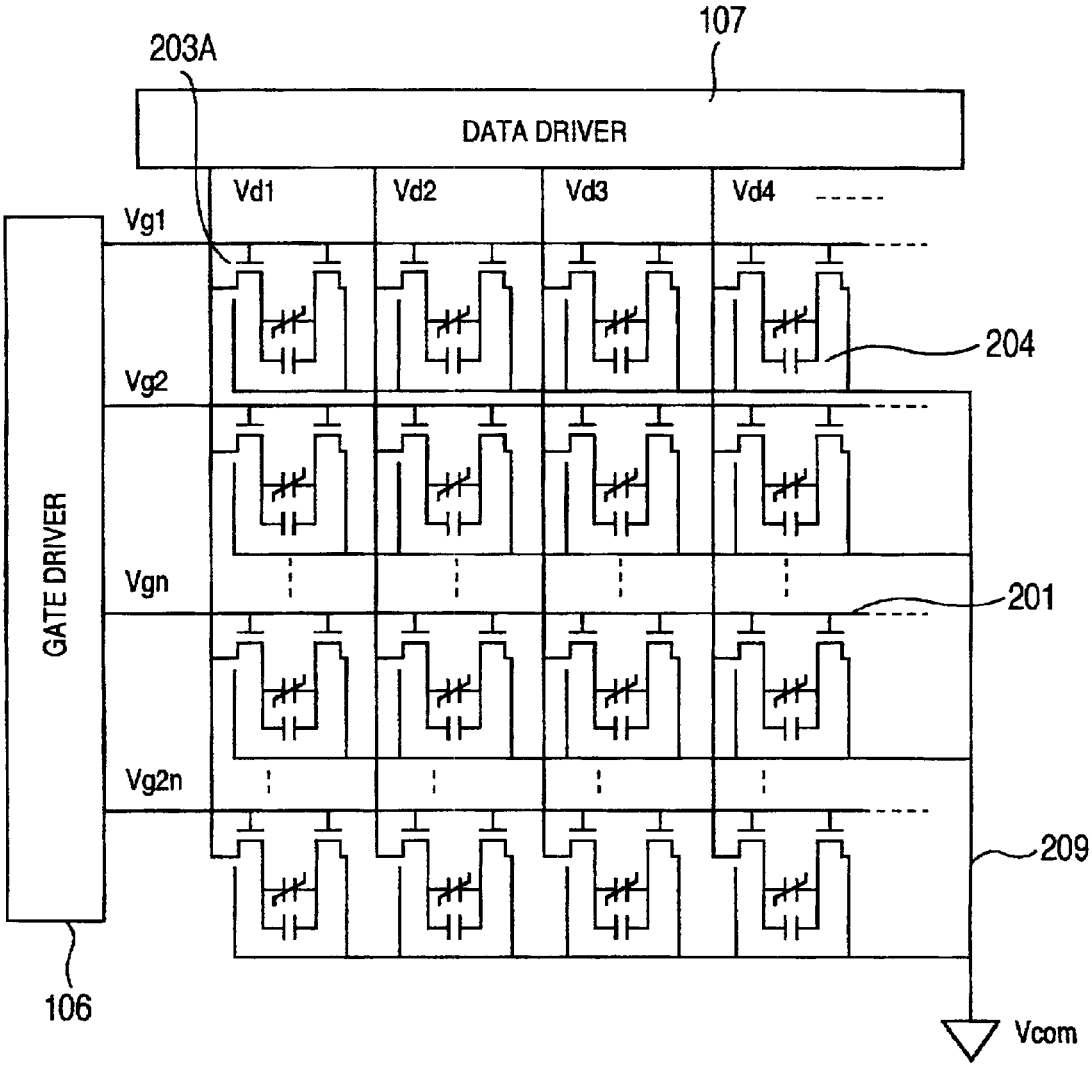
FIGS. 10A and 10B are views each showing an equivalent circuit of a liquid crystal display apparatus according to a third embodiment of the present invention.
Figure 10B:
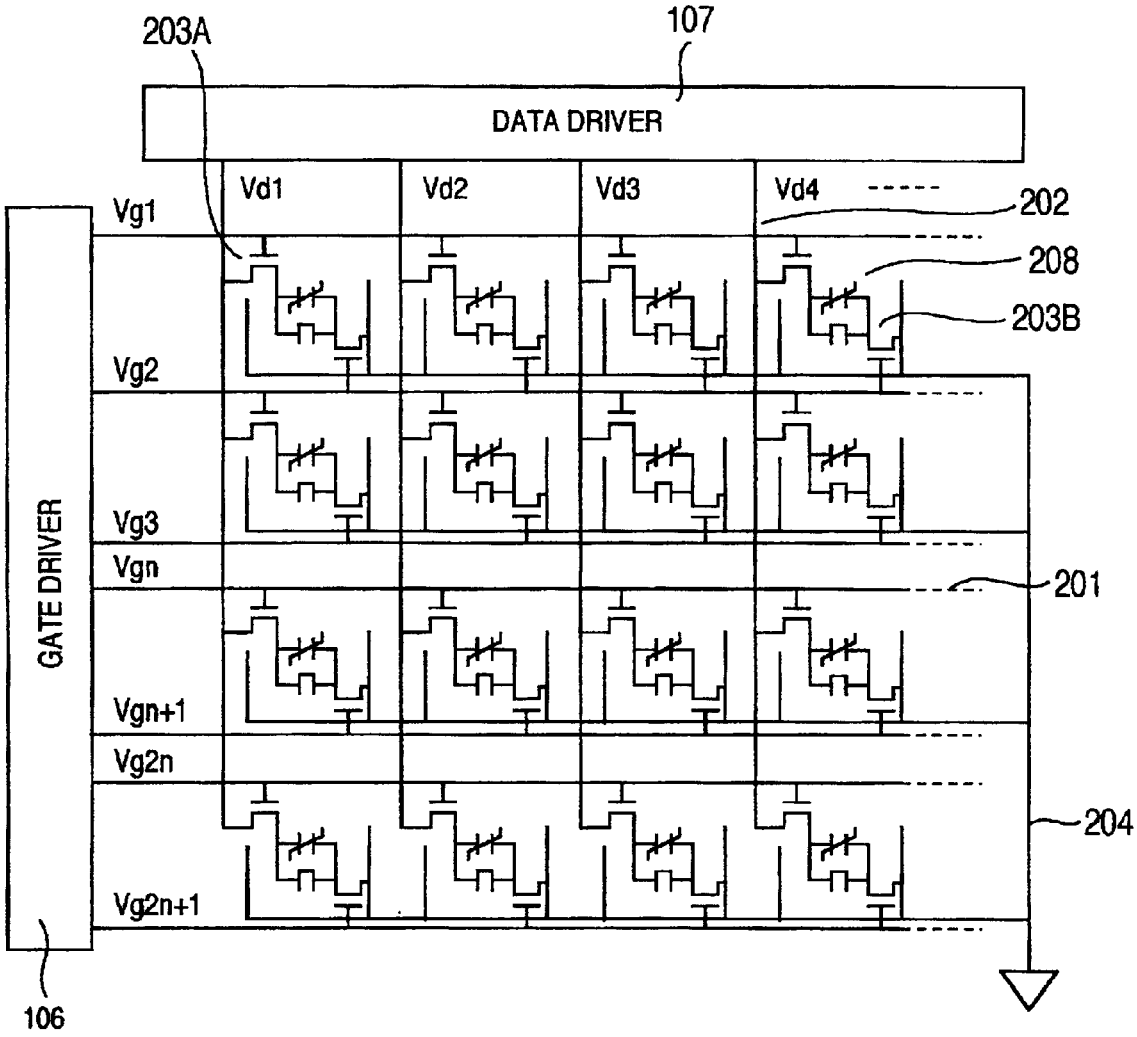
Figure 11:
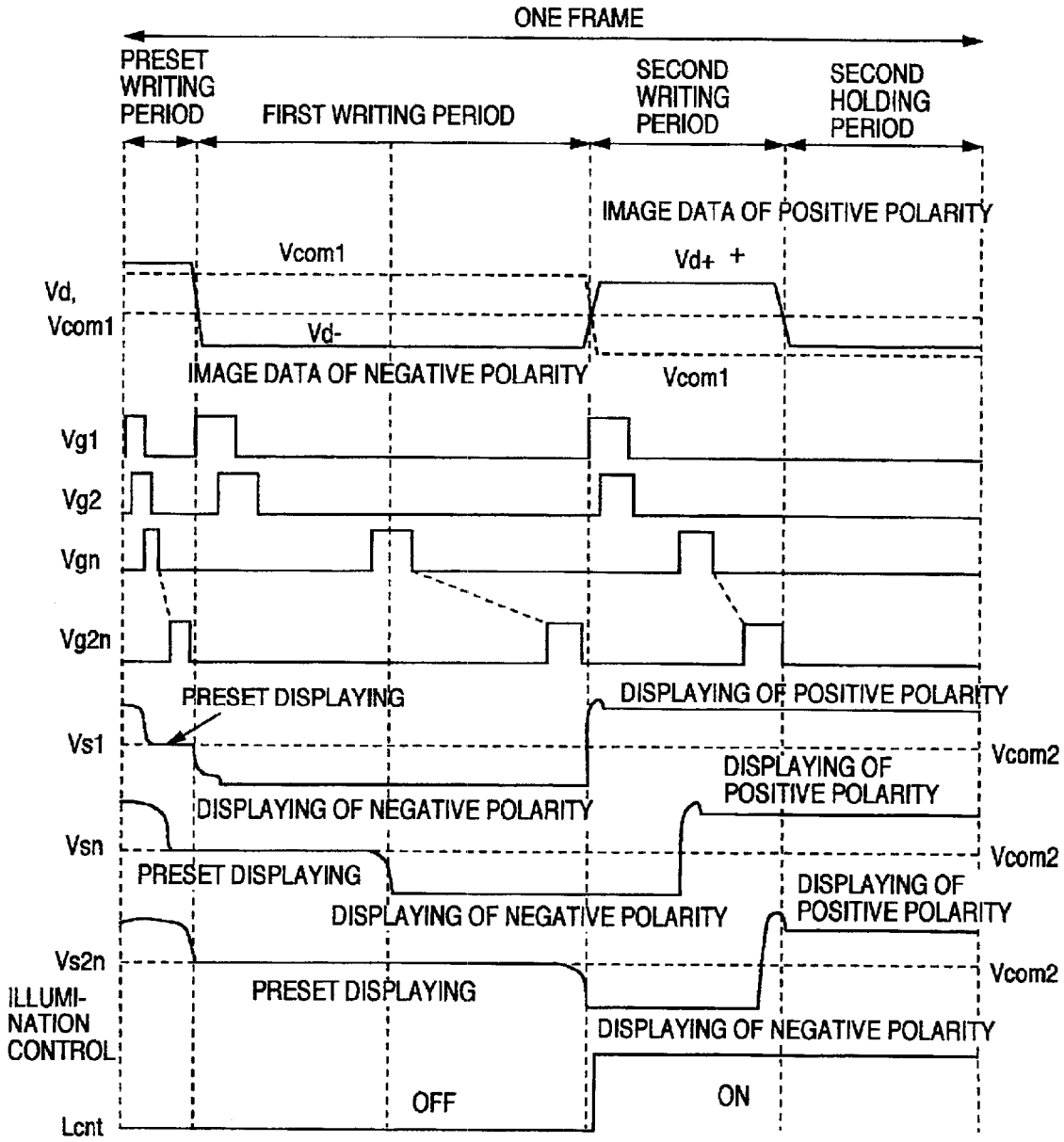
FIG. 11 is an equivalent circuit view of another liquid crystal display apparatus of the third embodiment of the invention.
Figure 27A:
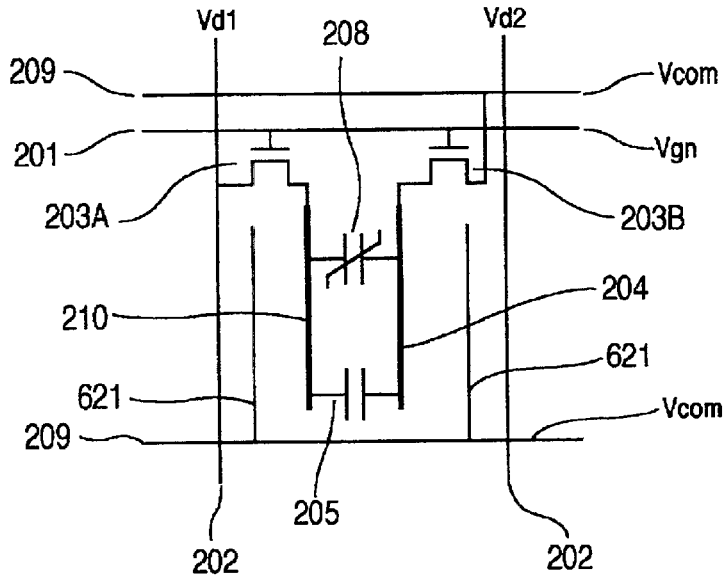
FIGS. 27A and 27B are views each showing an example of a pixel equivalent circuit and a pixel layout in the third embodiment of the invention.

Next, description is made of a third embodiment of the present invention by referring to FIGS. 10A and 10B, 11 and 27A and 27B, and FIGS. 28A to 34. As in the case of the first embodiment of the invention, the embodiment is applied to a normally black n-plane switching mode. The invention provides a liquid crystal display apparatus capable of controlling brightness of a motion image, and suppressing longitudinal smear or crosstalk. The embodiment can also be applied to a display mode, in which a common wiring and a common electrode can be provided on the same substrate, a display mode, in which a common wring and a common electrode are provided on opposing substrates, and a display mode, in which circuits capable of individually controlling common writings are provided on opposing substrates. Each of FIGS. 10A and 10B shows an equivalent circuit in a display unit of the liquid crystal display apparatus of the embodiment; FIG. 11 a driving sequence of the embodiment; FIGS. 27A and 28B, and FIGS. 28A and 28B an equivalent circuit of a pixel of the embodiment, and an example of its layout; FIG. 29 an equivalent circuit of one pixel for illustrating a method for further improving display performance of the embodiment; and FIGS. 30 to 34 some examples of pixel layouts of the embodiment improved based on consideration made with reference to FIG. 29.

Each of FIGS. 10A and 10B shows the equivalent circuit of the display unit in the liquid crystal display apparatus of the embodiment. A basic configuration is similar to that of the first embodiment. Each pixel is composed of two active elements. A drain terminal of the first active element is connected through a column wiring to an output of a data driver as in the case of the conventional example. A feature is that a drain terminal of the second active element is connected to a common wiring, and a source terminal of the same is connected to a common electrode as a reference potential when a voltage is applied to a liquid crystal. A difference between FIGS. 10A and 10B is a connection destination of a gate terminal of the second active element. In FIG. 10A, the gate terminal is connected to a line wiring common to the first active element; and in FIG. 10B, to a next line wiring. In FIG. 10A, since the gate terminal of the second active element is connected to the line wiring common to the active element, after completion of writing in the pixel, the process moves to a holding period and, simultaneously, high resistance states are set not only between a pixel electrode and a fixed potential but also between the common electrode and the fixed potential. In FIG. 10A, since the gate terminals of the first and second active elements are connected to the same line wiring, the number of lines constituting a pixel, and the number of line wirings for controlling the active elements can be set equal to each other. In FIG. 10B, since the gate terminal is connected to the next line wiring, one line must be added to the number of line wirings compared with the number of lines constituting a pixel. However, after sufficient stabilization of voltage writing in the pixel, high resistance states can be set for the common electrode and between the common electrode and a fixed potential, and the process can be moved to a holding period after a pixel potential is written more stably. By setting the common electrode in a high resistance state in the holding state, the pixel electrode for applying a voltage to the liquid crystal, and the common electrode are made independent of each other excluding slight parasitic capacitance. Thus, crosstalk in the pixel electrode by a column electrode, to which a voltage is applied according to an image, can be greatly suppressed and, even in the second writing period, in which the image was not made visible by lighting the illuminator in the first embodiment, and in the case of a still image needing no motion image performance, also in the first writing period, the illuminator is lit by permitting slight luminance inclination, the image can be visible.

FIG. 11 shows the driving sequence of the embodiment, which is substantially similar to that of the first embodiment. However, a difference is that an illumination control signal is applied substantially in synchronization with a starting time of the second writing period. Accordingly, a light period of the illuminator can be twice as long as that of the first embodiment, making it possible to achieve average luminance larger by twice even when an illuminator having similar luminance is used. However, since it is only a slightly slow motion image that reaches a detection limit as motion image performance, selective use is preferred by providing switches to be set according to user's preference or a type of an image.

Figure 27B:
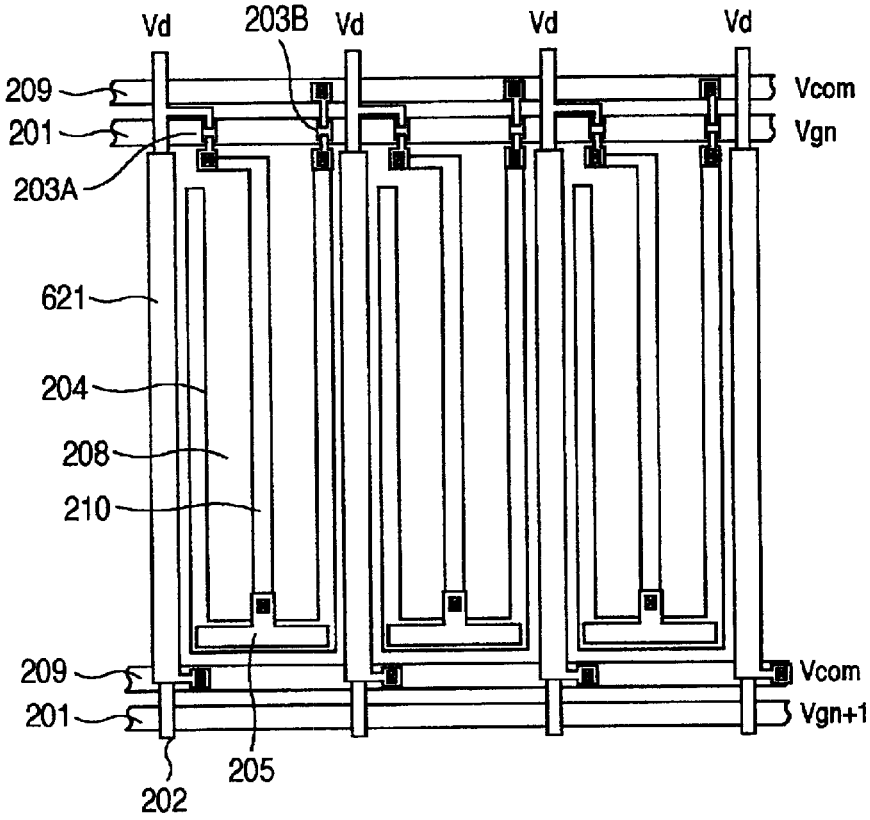
Figure 28A:
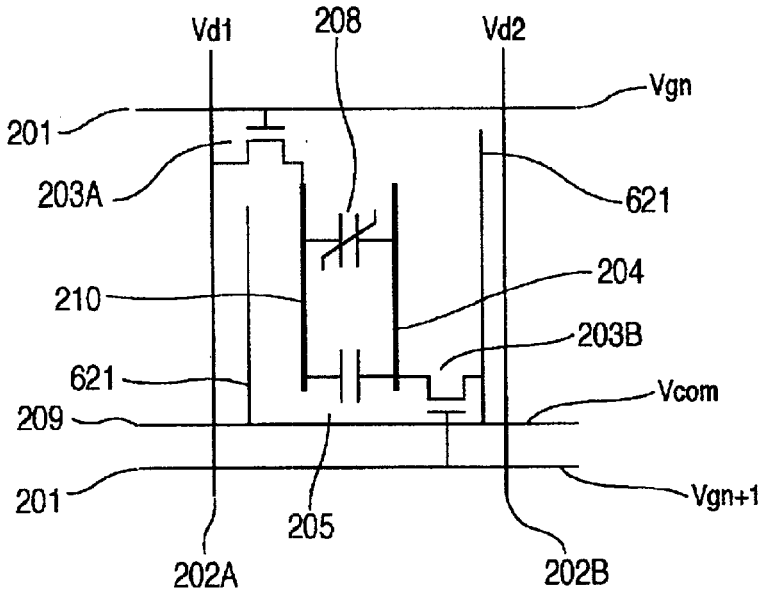
FIGS. 28A and 28B are views each showing an example of a pixel equivalent circuit and a pixel layout in the third embodiment of the invention.
Figure 28B:
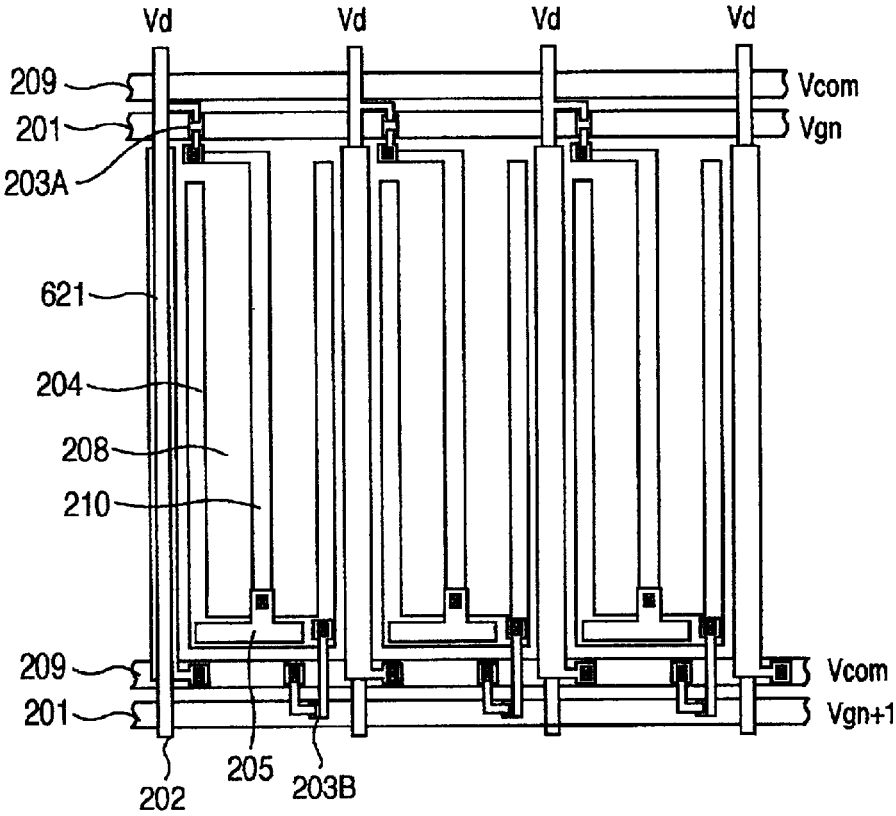
Figure 29:
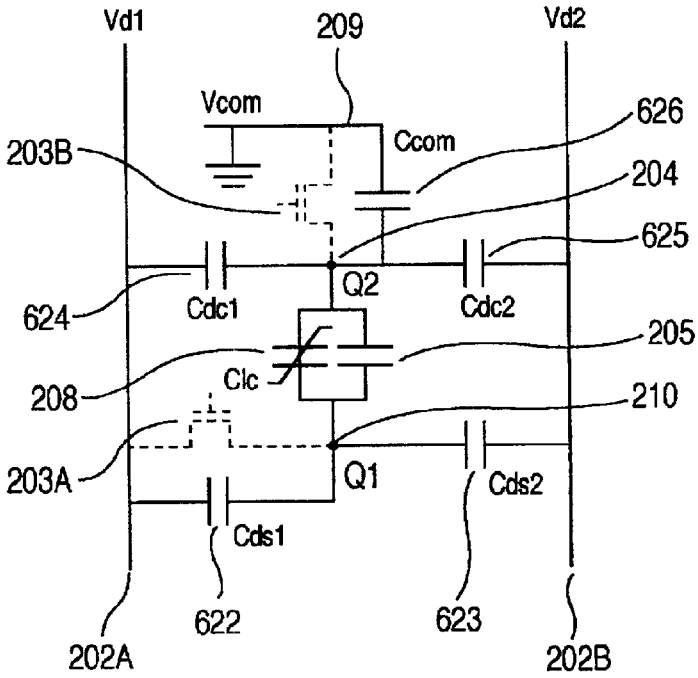
FIG. 29 is an equivalent circuit view of a pixel illustrating display performance of the third embodiment of the invention.

Each of FIGS. 27A and 27B, and FIGS. 28A and 28B shows suitable image structure of the embodiment. FIG. 27A shows an equivalent circuit of one pixel in the display apparatus of the embodiment; and 27B a layout of the pixel. In FIG. 27B, a light radiated by a not-shown illuminator is controlled for transmissivity by electrooptical property of a liquid crystal supplied between a pixel electrode 210 for applying a voltage to the liquid crystal and a common electrode 204, and a not-shown polarizing plate disposed in a cross and col relation with the outside, and an image is made visible in the entire liquid crystal display apparatus. In this case, the liquid crystal operates as a capacitive element 208 between the pixel electrode 210 and the common electrode 204, and its electro-optical property, i.e., transmissivity, is changed upon an effect of an electrostatic force from the outside. A shield electrode 621 electrically shuts off electrostatic noise (normally called electric crosstalk) in the liquid crystal by a common wiring potential not dependent on a displayed image, the electrostatic noise being generated by fluctuation in a column wiring 202 for transmitting a voltage output of a data driver to the active element of each pixel. Preferably, as shown in FIG. 28B, almost complete covering of the column electrode is preferable for shielding performance and a numerical aperture. However, if multilayer formation is impossible because of process constraints, a similar effect is obtained by disposing the shield electrode between the column wiring 202 and the pixel electrode 210. FIG. 28A shows an equivalent circuit of one pixel of the display apparatus of the embodiment of FIG. 10B; and FIG. 28B a layout of the pixel. In the embodiment, an effect of stable writing of a pixel potential is added, which is achieved by performing control with a line wiring Vgn+1 of a next stage of a second active element 203A. Other than this, effects completely similar to those shown in FIG. 27B are obtained.

According to the embodiment, by the two active elements, all the electrodes related to displaying can be set in high resistance states of high writing capabilities during writing, and high resistance states and small parasitic capacitance connections having excellent electrostatic shielding capabilities in the holding state. Thus, in addition to the effect of the shield electrode, it is possible to achieve good displaying having crosstalk greatly suppressed. Moreover, by combining the embodiment with the first and second embodiments, it is possible to achieve bright motion image displaying having a high display duty.

The embodiment is designed for achieving a high duty in motion image displaying. However, in the case of normal still image displaying, the embodiment is effective for lowering voltages of the data driver and the entire display apparatus by AC setting of the common wiring.

The embodiment enables crosstalk to be greatly suppressed. For the purpose of further improving image quality, crosstalk is now quantitatively analyzed. FIG. 29 shows, in detail, an equivalent circuit including a paratactic capacitor of one pixel. In the drawing, crosstalk from column electrodes 202A and 202B is generated in a holding state. In this case, since the two active elements 203A and 203B operate in high resistance states, these are indicated by broken lines as reference. Now, analysis is made of crosstalk by data driver outputs Vd1 and Vd2 of the column electrodes 202A and 202B of two columns. A liquid capacitor 208 and a holding capacitor 205 are referred to as a pixel capacitor C1c. Parasitic capacitors Cds1 and Cdc1 of the column electrode 202A related to Vd1, and parasitic capacitors Cds2 and Cdc2 of the column electrode 202B related to Vd2 are respectively connected to the pixel electrode 210 and the common electrodes 204 in both ends of the pixel capacitor C1c. A parasitic capacitor Dccm26 of the second active element is connected between the common wiring Vcom and the common electrode 204. A parasitic capacitor of the active element 203A is also present by a size substantially equal to that of the active element 203B. Normally, however, the size is small enough to be ignored compared with the parasitic capacitor Cds1 between the wirings, and thus this capacitor is included in the parasitic capacitor Cds1 for discussion.

With a potential of the common wiring set as a reference potential, voltages in both ends of each capacitor are decided as follows. Both-end voltage of a parasitic capacitor 626 of the second active element 203B is Vccm, both-end voltage of a parasitic capacitor 624 between a wiring and an electrode is Vdc2, thereafter similarly, both-end voltage of a parasitic capacitor 625 Vdc2, both-end voltage of a parasitic capacitor 622 Vds1, both-end voltage of a parasitic capacitor 623 Vdc2, and both-end voltages of pixel capacitors 208 and 205 V1c. In this case, considering potentials of the common electrode 204 and the pixel electrode, relations are respectively represented by the following equations (1) and (2):

$$Vccm=Vd1+Vdc2=Vd2+Vdc2 \quad (1)$$

$$Vccm+V1c=Vd1+Vds1=Vd2+Vds2 \quad (2)$$

Charges applied by the active elements 203A and 203B to the pixel electrode 210 and the common electrode 204 are respectively Q1 and Q2. These charges are represented by the following equations (3) and (4):

$$Q1=Cds1\times Vds1+Cds2\times Vds2+C1c\times V1c \quad (3)$$

$$Q2=Cdc1\times Vdc1+Cdc2\times Vdc2+Cccm\times Vccm-C1c\times V1c \quad (4)$$

Voltage fluctuation amounts of the column wirings are respectively ΔVd1 and ΔVd2. If charge fluctuation amounts ΔQ1 and ΔQ2 in the respective electrodes are obtained from the above-described equations (1) to (4), then these are represented by the following equations (5) and (6):

$$\Delta Q1=-Cds1\times\Delta Vd1-Cds2\times\Delta Vd2+(Cds1+Cds2+C1c)\times\Delta V1c+(Cds1+Cds2)\times\Delta Vccm \quad (5)$$

$$\Delta Q2=-Cds1\times\Delta Vd1-Cds2\times\Delta Vd2-C1c\times\Delta V1c+Cccm\times\Delta Vccm \quad (6)$$

Here, ΔQ1=ΔQ2=0 is established because of a charge conservation principle. Accordingly, a fluctuation amount ΔV1c of both-end voltage of the pixel capacitor is obtained from the equations (5) and (6), it is represented by the following equation (7):

$$\Delta V1c=\tfrac{1}{2}\times C1c+Cds1+Cds2\cdot((Cds1-Cds1)\times\Delta Vd1+(Cds2-Cdc2)\times\Delta Vd2+(Cccm-Cds2)\times\Delta Vccm) \quad (7)$$

Here, to prevent changes in both-end voltage of the pixel capacitor, because of ΔV1=0, the following equation (8) applies:

$$\Delta Vccm=-1/Ccm-Cds1-Cds2\cdot((Cds1-Cds1)\times\Delta Vd1+(Cds2-Cdc2)\times\Delta Vd2) \quad (8)$$

To always establish the equation (8), the following condition represented by the equation (9) must be satisfied:

$$Cds1=Cdc1 \text{ and } Cds2=Cdc2 \quad (9)$$

Such a structure is achieved by setting a capacitor between left and right column wirings adjacent to each pixel and the pixel electrode of each pixel equal to a capacitor between each column wiring and the common electrode of each pixel. To set two parasitic capacitors equal to each other for each column wiring, distances to the column wiring are set equal to each other, and lengths of wirings opposite the column wiring, i.e., opposing lengths, are set equal to each other. Other than the above, a method of designing parasitic capacitors of the equation (9) equal to each other by capacity calculation is effective.

Each of FIGS. 30 to 34 shows a pixel structure example for achieving the equation (9).

Figure 30:
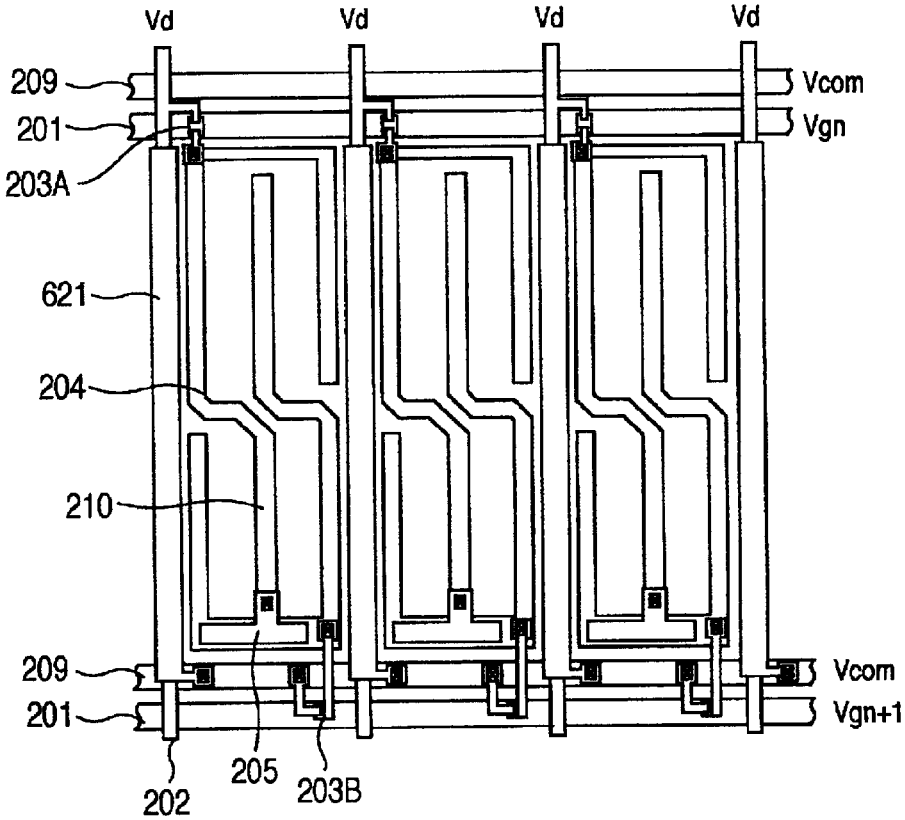
FIG. 30 is a view showing a layout of several pixels in the third embodiment of the invention.

Specifically, FIG. 30 shows an embodiment, where with the basic configuration of FIGS. 28A and 28B as a basis, in the center part of a pixel, disposition of a pixel electrode 210 and a common electrode 204 is changed in left-right and center relation. Accordingly, parasitic capacitances seen from a column wiring 202 are substantially equal between pixel electrodes and between common electrodes. Thus, by the equation (9), even if any voltage fluctuation occurs in the column electrode, no fluctuation occurs in a potential difference between the pixel electrode and the common electrode, i.e., a voltage applied to a liquid crystal of the pixel portion.

Figure 31:
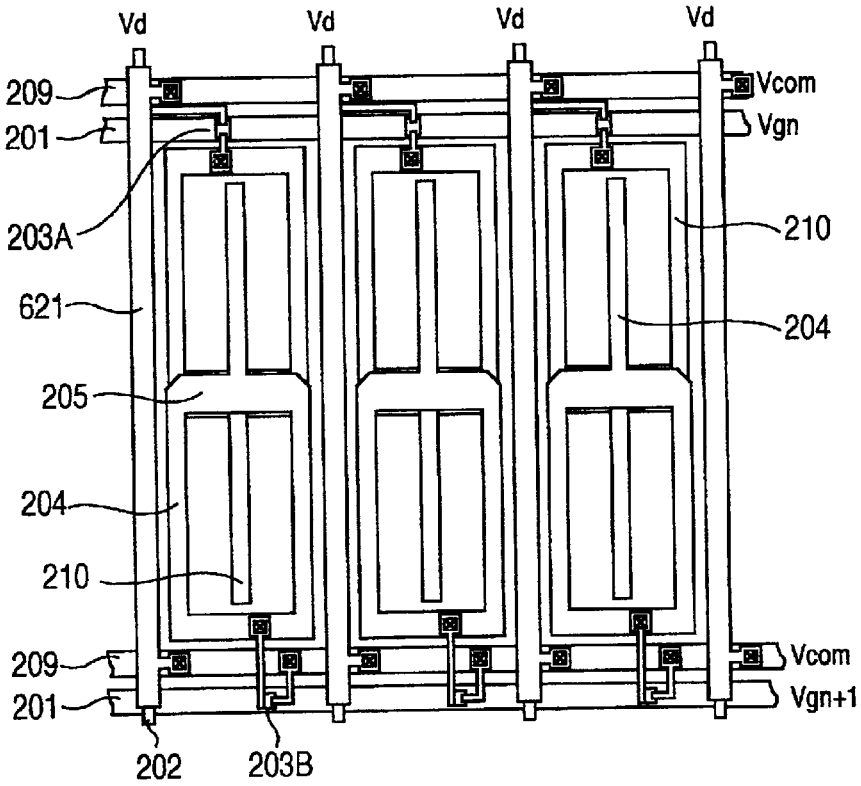
FIG. 31 is a view showing a layout of several pixels in the third embodiment of the invention.

FIG. 31 shows an arrangement, where an overlapped portion of the pixel electrode and the common electrode is provided in a center of the pixel, and this overlapped portion is set as a holding capacitor 205. In addition, two active elements 203A and 203B are also disposed in the center of the pixel in a line direction, and electrostatic crosstalk by column electrodes in both left and right sides is limited to a minimum. To suppress voltage distortion of a common wiring during writing, respective common wirings 209 are connected in a column direction by a shield electrode 621, forming a meshed structure. Accordingly, a charging current can be dispersed to adjacent or separated common wirings during voltage writing, and voltage fluctuation is suppressed during writing. Thus, it is possible to display an image of higher quality.

Figure 32:
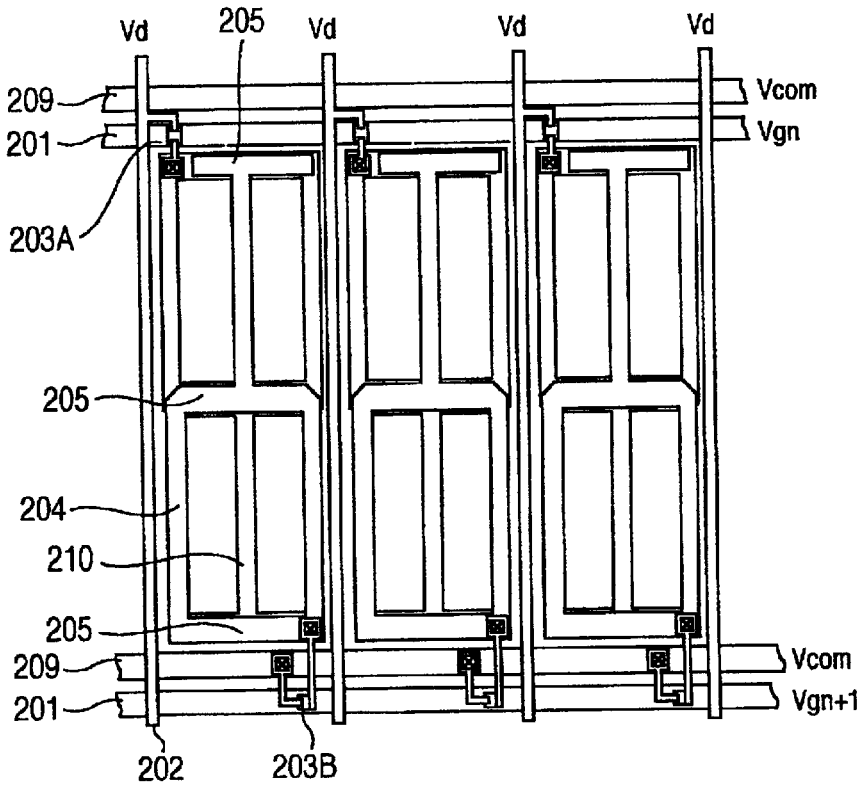
FIG. 32 is a view showing a layout of several pixels in the third embodiment of the invention.

FIG. 32 shows an arrangement similar to the embodiment of FIG. 31, which has a feature that a shield electrode is omitted. By omitting the shield electrode, an opening of a pixel decided by an area between a pixel electrode and a common electrode can be enlarged, making it possible to perform brighter displaying. Furthermore, since a shield electrode forming step can be removed from a process, it is possible to achieve a structure having high mass-productivity.

Figure 33:
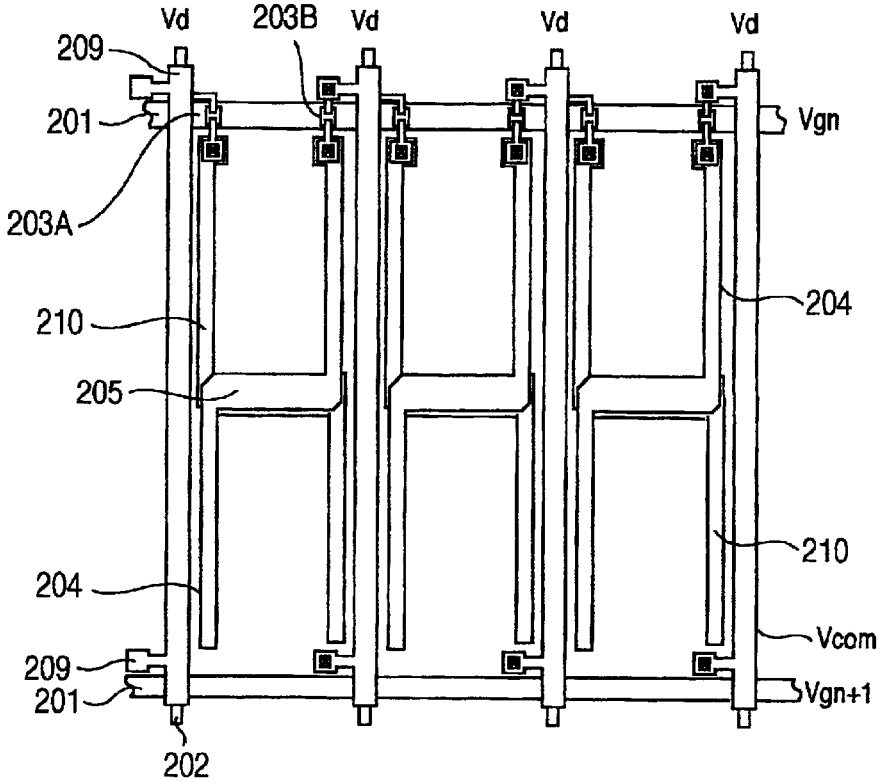
FIG. 33 is a view showing a layout of several pixels in the third embodiment of the invention.

FIG. 33 shows an arrangement of a common wiring pulled out in a column direction, where the common wiring serves also as a shield electrode. According to the embodiment, since the number of pixels necessary for carrying a charging current during writing is only one, it is possible to achieve displaying of high image quality having little voltage distortion of the common wiring caused by writing.

Figure 34:
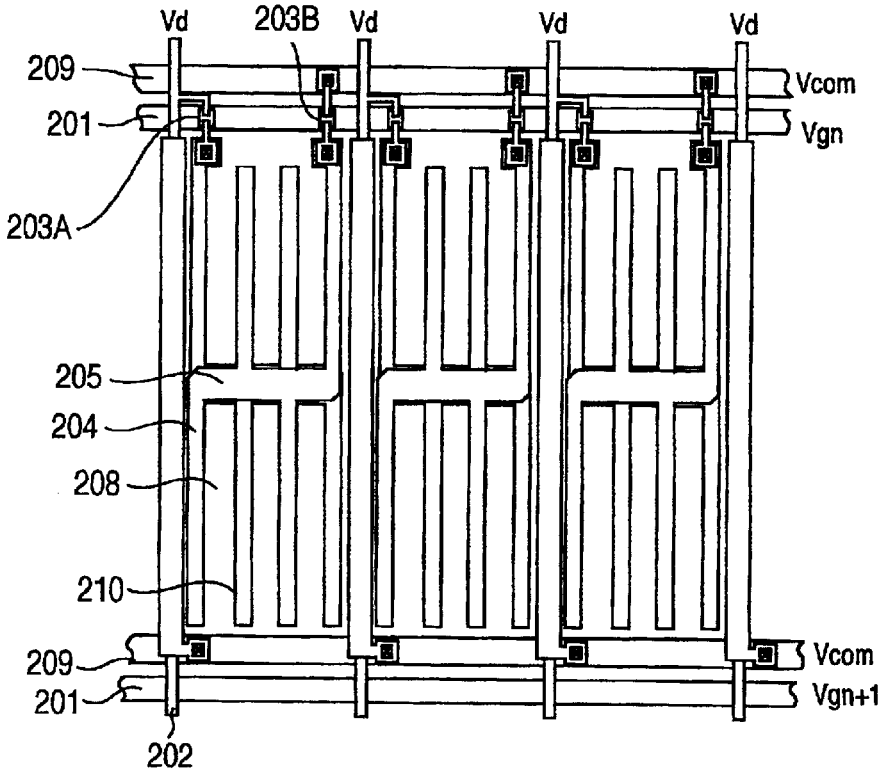
FIG. 34 is a view showing a layout of several pixels in the third embodiment of the invention.

FIG. 34 shows an arrangement, where in addition to two-division of a pixel in upper and lower direction, the pixel is divided into three parts in left and right directions. As apparent from the previous embodiments, when the number of divided parts in the left and right directions is odd, as shown in the embodiment, by controlling two active elements with the same line wiring, a pixel structure of a high numerical aperture with little space waste can be achieved. However, the two active elements can also be controlled by different line wirings at a little sacrifice of a numerical aperture.

According to the above-described embodiment, the first and second active elements are set in conductive states in the period of writing voltage in the liquid crystal, and in high resistance states in the holding period. The pixel electrode structure is achieved, where voltage crosstalk from the column wiring is almost completely suppressed. Thus, it is possible to provide a liquid crystal display apparatus of high image quality having little cross talk in the holding period.

Furthermore, according to the embodiment, when a low voltage is set for the entire display apparatus by the AC setting of the common wiring, and the embodiment is applied to displaying of a motion image, even only by AC setting for each frame or each subframe, no crosstalk is generated even while a voltage on the column electrode is in a fluctuating state. Thus, a driving duty can be greatly increased until the wiring period, making it possible to achieve brighter displaying.

Fourth Embodiment

Next, detailed description is made of a fourth embodiment by referring to FIGS. 12 to 17.

The embodiment provides a displaying method capable of preventing any great loses of visibility even when luminance inclination is brought about by an optical response of a liquid crystal, in a liquid crystal display apparatus adapted to make an image visible by intermittently lighting an illuminator.

Figure 12:
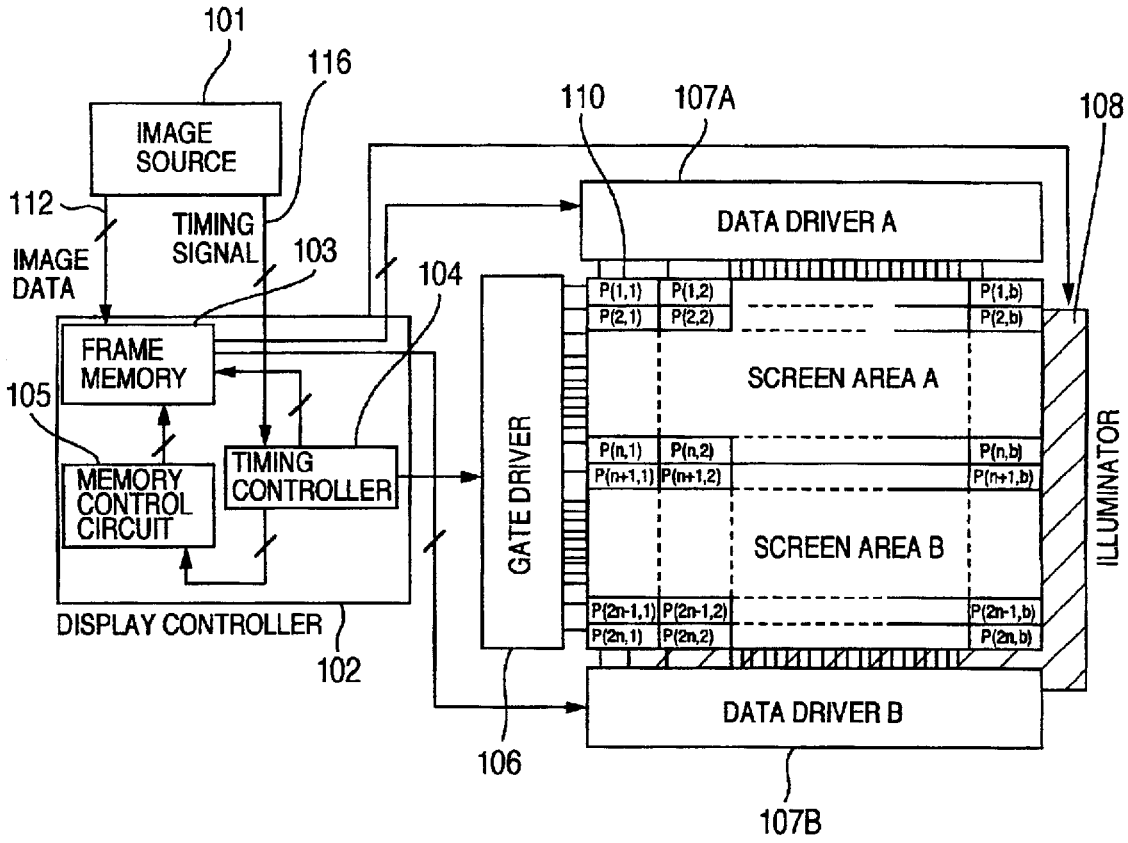
FIG. 12 is a block diagram showing a configuration of a liquid crystal display apparatus according to a fourth embodiment of the present invention.

FIG. 12 shows an example of the liquid crystal display apparatus of the embodiment. This liquid crystal display apparatus includes an image source 101, a display controller 102 incorporating a frame memory 103, a timing controller 104 and a memory control circuit 105, a liquid crystal panel, data drivers A and 107A for supplying image data to a pixel of an upper half of the liquid crystal panel, data drivers B and 107B for supplying image data to a pixel of a lower half of the liquid crystal panel, a gate driver 106, and an illuminator 108. However, the apparatus is not limited to such a configuration. An example of a direct input from the Image source not through the frame memory or an example of a memory incorporated in the data driver can be similarly used.

Figure 13:
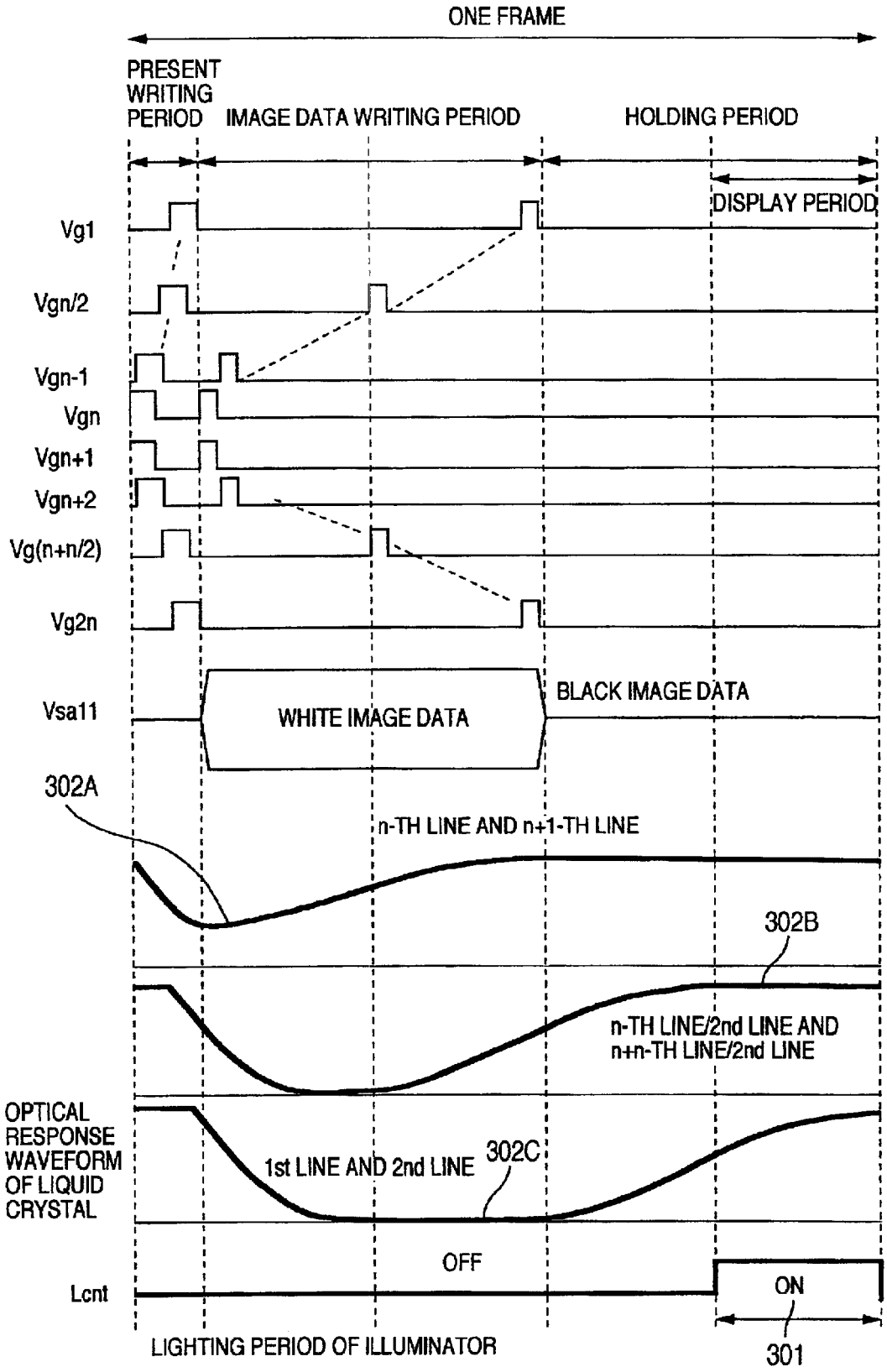
FIG. 13 is a view showing a driving sequence of the fourth embodiment of the invention.

The embodiment is described by way of example, where white displaying is carried out on a full surface of a screen for each frame. First, description is made of a driving sequence of a display system of the embodiment. FIG. 13 shows the driving sequence of the embodiment. In a first short period of a frame, preset writing is carried out. The preset writing in this case means writing of black display image data on a full surface of the screen. Then, white display image data is written on a full surface of the screen, and scanning is performed. After the white display image data writing and scanning, the writing operation is stopped, black display image data is supplied to a column wiring 202, and crosstalk by a parasitic capacitor of an active element 203 is reduced. The illuminator is lit for a period of ¼ of a last part of the frame, for which writing has been finished.

Here, since the preset writing must be carried out in the first short period of the frame, a line to be selected is scanned at a high speed by being overlapped with a plurality of lines. In addition, a potential applied to a column electrode in a holding period is by black display image data. However, there is no limitation in this regard, and the column electrode may be fixed at a potential having least crosstalk. For example, in the case of a TN display mode, response delay of a liquid crystal reaching luminance near half tone is most conspicuous, and crosstalk easily occurs because of this response delay. Accordingly, by setting a potential to be applied to the column electrode in the holding period to be near half tone, crosstalk can be greatly reduced. However, if a potential of a common electrode is set to be AC from a first to second writing period as described above, a voltage luminance characteristic is changed by potential fluctuation of the common electrode, and thus its correction is necessary. In the embodiment, screen scanning is started from a center of the screen, i.e., a lowermost n-th line of screen areas A and 111A, in which image data are written by data drivers A and 107A, and an uppermost n+1-th line of screen areas B and 111B, in which image data are written by data drivers B and 107B. The scanning of the screen areas A and 111A, and the scanning of the screen areas B and 111B simultaneously proceed in upper and lower directions respectively. Lastly, image data are written in a fist line of the screen areas A and 111A, and a 2n-th line of the screen areas B and 111B, i.e., uppermost and lowermost lines of the screen, and then the scanning is finished.

In a scanning method of a typical liquid crystal display apparatus, lines are selected one by one from the upper side to the lower side of the screen, the image data is written, and selection of all the lines of the screen constitutes one frame. In the scanning method of the embodiment, since two lines are simultaneously selected, compared with the scanning method of selecting lines one by one, scanning is finished within a time of ½ if a selection period of one line is similar. That is, if one frame time of the embodiment is similar to that of the scanning method of selecting lines one by one, the scanning in the embodiment is finished within a time half of that of one frame. Needless to say, if a time of selecting one line is shortened, it is possible to achieve high-speed scanning of a time half or smaller than one frame.

Figures 14, 15:
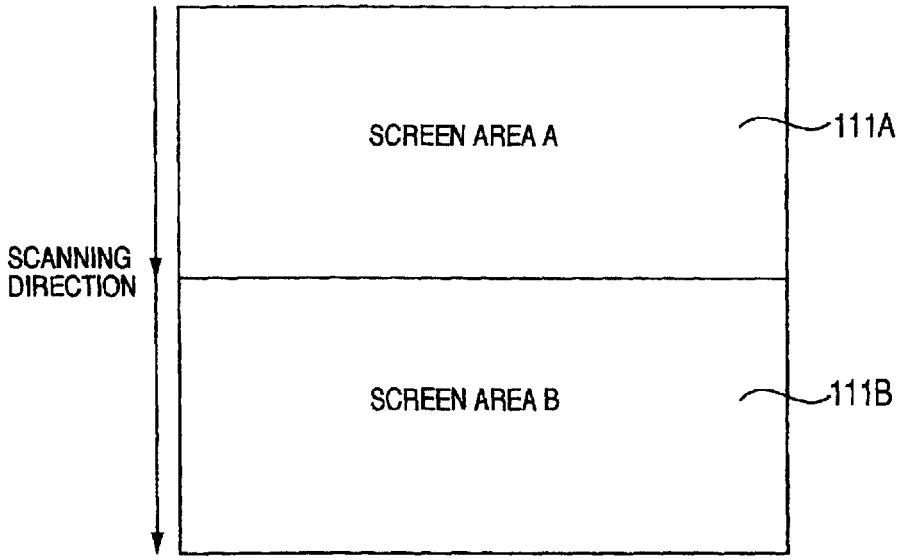
FIG. 14 is a view showing a relation between an address and data in a frame memory of the fourth embodiment of the invention.
FIG. 15 is an explanatory view showing a conventional upper-lower division driving method.

Next, description is made of a transfer method of image data for achieving the above-described driving sequence by FIGS. 12 and 14.

First, in FIG. 12, image data and a timing signal are sent from the image source 101 to the display controller 102. The image data sent to the display controller 102 is controlled by the timing signal, and stored in the frame memory 103. Here, the frame memory 103 can store image data of one screen or more.

In the embodiment, image data to be displayed on the upper half of the screen, i.e., in the screen areas A and 111A, must be sent to the data drivers A and 107A. Image data to be displayed on the lower half of the screen, i.e., in the data drivers B and 111B, must be sent to the data drivers B and 107B. Hereinafter, description is made of a method of transferring image data to the data driver.

As shown in FIG. 14, it is assumed that image data (I, j) 115 sent from the image source 101 is written in an address M (i, j) 112 in the memory. However, (I, j) corresponds to a pixel position (i, j) 110 of the display unit. Then, the image data is read from the address of the memory corresponding to each pixel position 110, controlled by the timing controller 104, and sent to each data driver.

In the embodiment, the screen of one frame is scanned in upper and lower directions from the center of the screen. Accordingly, in a first line selection period of one frame, for an image signal, data of an n-th line of a memory address shown in FIG. 14 is sent to the data drivers A and 107A, and data of an n+1-th line is sent to the data drivers B and 107B. The gate driver 106 supplies a potential for turning ON active elements in the pixels of the n-th and n+1-th lines of the display unit. The data sent to the data drivers A and 107A is converted into an analog signal, and supplied to the pixel of the n-th line of the display unit. The data sent to the data drivers B and 107B is converted into an analog signal, and supplied to the pixel of the n+1-th line of the display unit. Then, the gate driver 106 supplies a potential for turning OFF the active elements in the pixels of the n-th and n+1-th lines of the display unit to each line wiring, completing first line selection.

In a next line selection period, data written in an address of an n−1t-th line in the memory is sent to the data drivers A and 107A, and data written in an address of an n+2-th line is sent to the data drivers B and 107B. The gate driver 106 supplies a potential for turning ON active elements in pixels of the n−1-th and n+2-th lines of the display unit. The data sent to the data drivers A and 107A is converted into an analog signal, and supplied to the pixel of the n−1-th line of the display unit. The data sent to the data drivers B and 107B is converted into an analog signal, and supplied to the pixel of the n+2-th line of the display unit. Then, the gate driver 106 supplies a potential for turning OFF the active elements 203 in the pixels of the n−1-th and n+2-th lines of the display unit to each line wiring 201, completing a second line selection period.

Similarly thereafter, the screen is scanned from the center of the display unit in upper and lower directions. Lastly, data of a first line of a memory address is sent to the data drivers A and 107A, and data of a 2n-th line of a memory address is sent to the data drivers B and 107B. The gate driver 106 turns ON active elements 203 in the pixels of the first and 2n-th lines of the display unit. The data sent to the data driver A and 107A is converted into an analog signal, and supplied to the pixel of the fist line of the display unit. The data sent to the data drivers B and 107B is converted into an analog signal, and supplied to the pixel of the 2n-th line of the display unit. Then, the gate driver 106 supplies a potential for turning OFF the active elements 203 in the pixels of the first and 2n-th lines of the display unit to each ling wiring 201, completing the screen scanning. The method of achieving the driving sequence of the embodiment has been described in detail.

Figure 16:
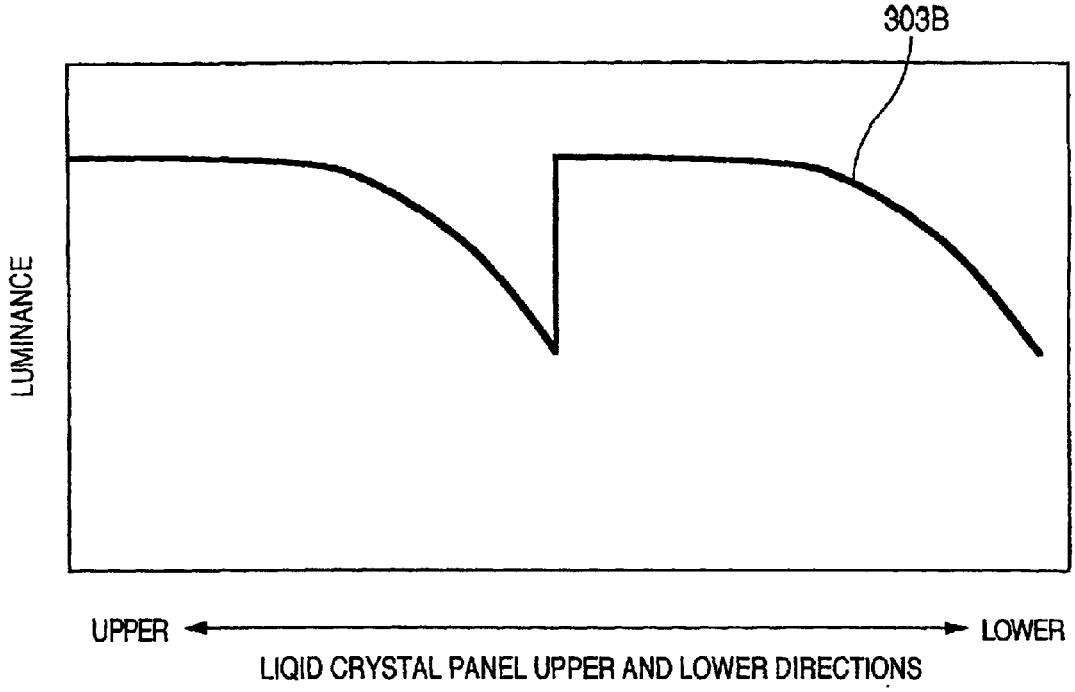
FIG. 16 is an explanatory view showing a luminance distribution of the conventional upper-lower division driving method.

If upper and lower halves of the screen are both scanned from the upper side to the lower side as shown in FIG. 15, then luminance inclination exhibits steel luminance changes in the upper and lower half areas of the screen as shown in FIG. 16,l resulting in a great loss of visibility.

Figure 17:
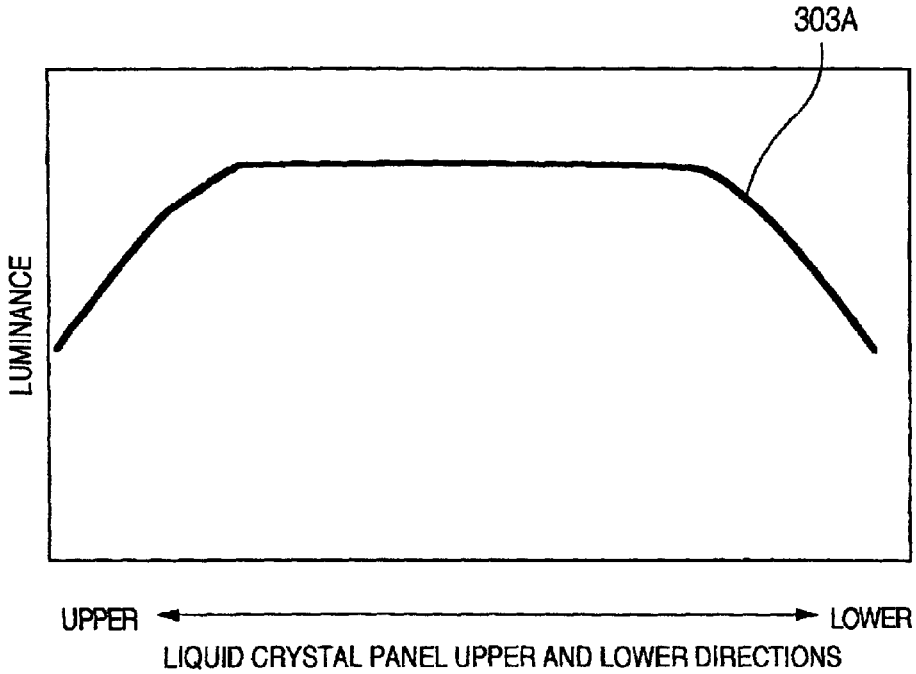
FIG. 17 is an explanatory view showing a luminance distribution of an upper-lower division driving method of the present invention.

If scanning is carried out from the center of the screen in upper and lower directions according to the embodiment and, after the scanning, the illuminator is 108 is lit to carry out displaying, even when a distribution of luminance is largest in the center of the screen, and a reduction occurs in luminance because of an optical response of a liquid crystal as shown in FIG. 17, areas of luminance reduction are limited to upper and lower ends of the screen, making it possible to prevent a great loss of visibility. Moreover, since the displaying is carried out by intermittently lighting the illuminator, it is possible to obtain a liquid crystal display apparatus for displaying a motion image having little blurring.

Fifth Embodiment

Figure 18:
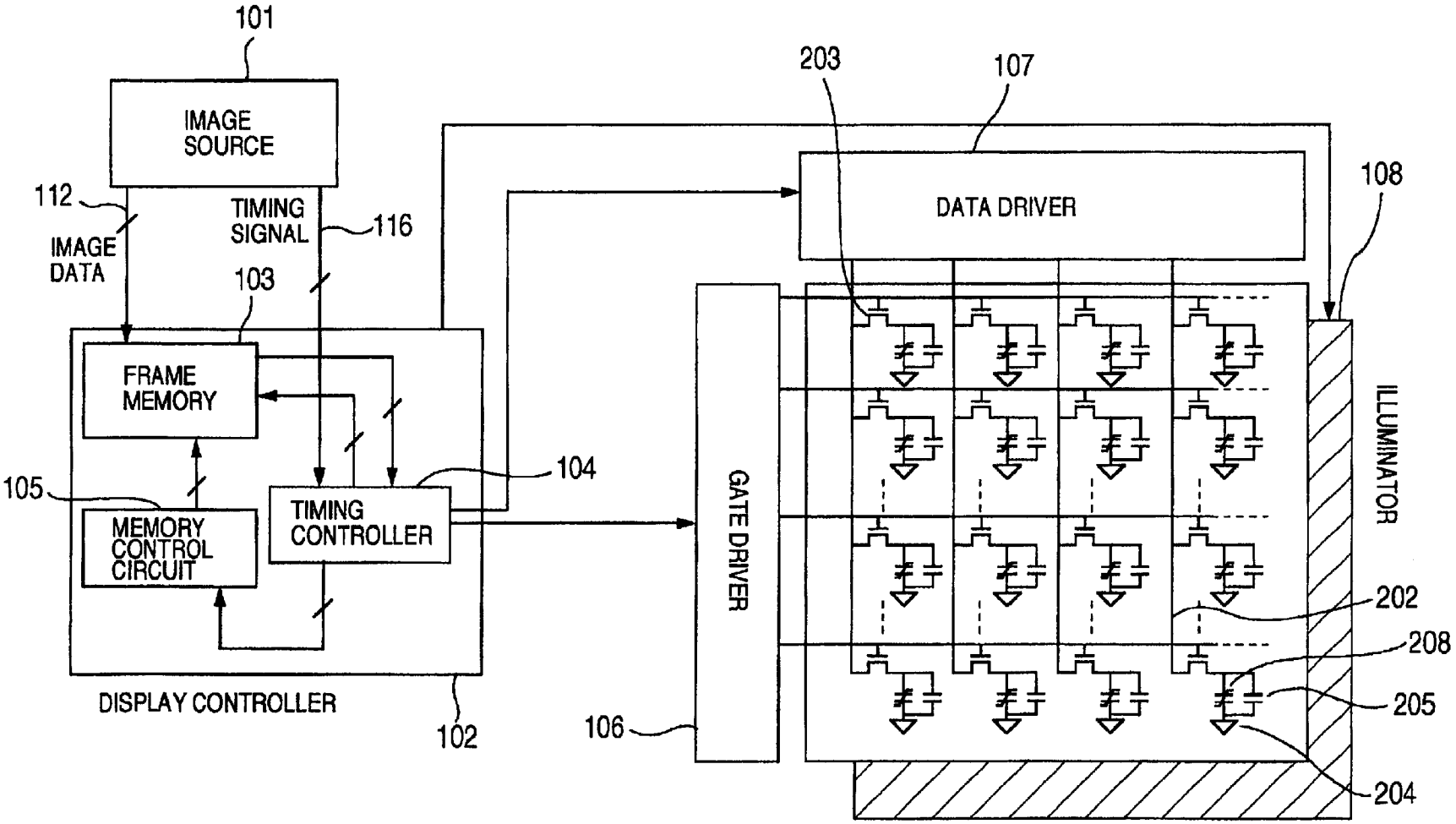
FIG. 18 is a block diagram showing a configuration of a liquid crystal display apparatus according to a fifth embodiment of the present invention.
Figure 19:
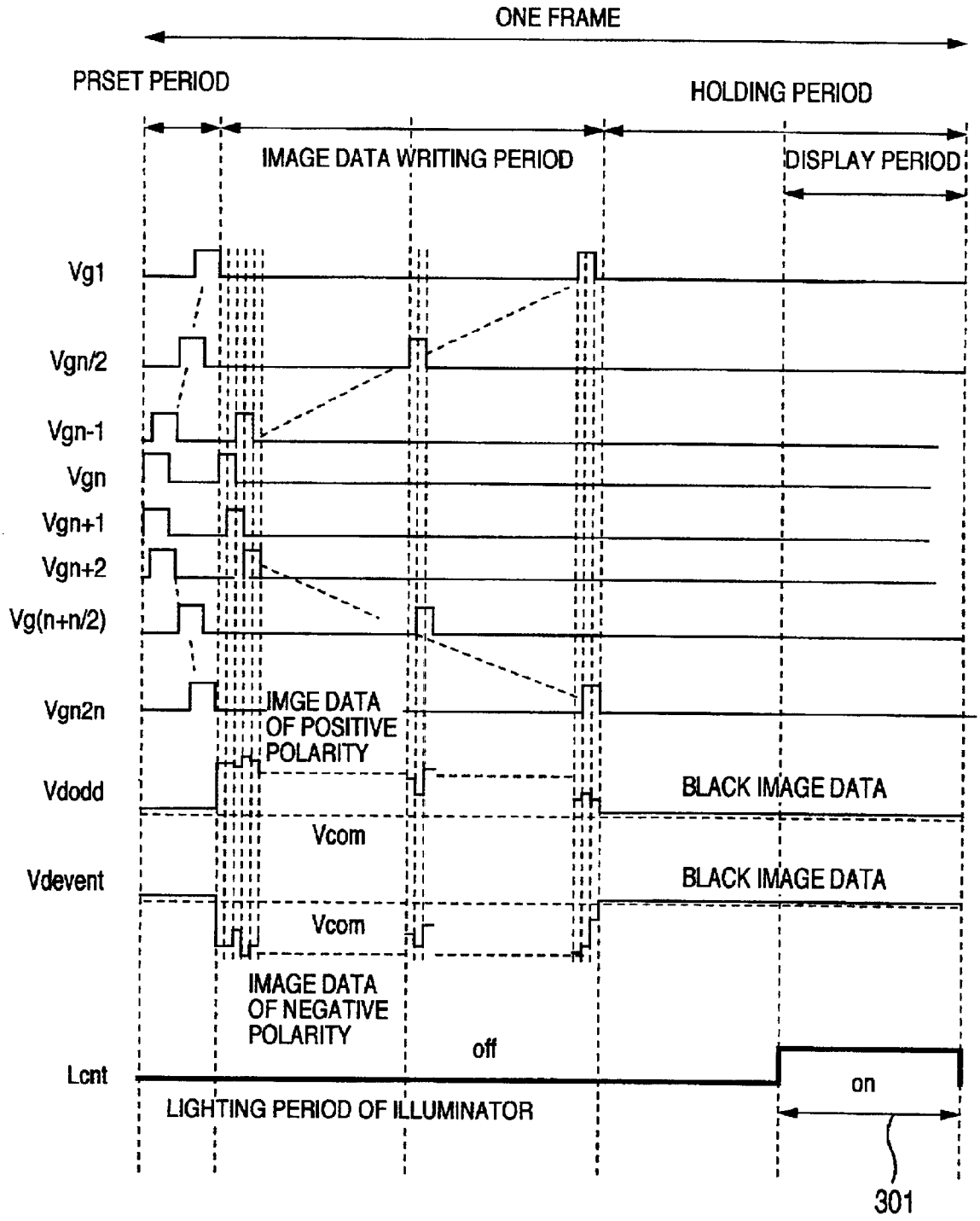
FIG. 19 is a view showing a sequence of the fifth embodiment of the invention.

Next, description is made of a fifth embodiment by referring to FIGS. 18 to 20. According to the embodiment, as in the case of the fourth embodiment, image data writing and scanning are carried out from almost a center of a screen in both upper and lower directions. Thus, in a liquid crystal display apparatus for making an image visible by intermittently lighting an illuminator, a display method is provided, which can prevent a great loss of visibility even when luminance inclination is brought about by an optical response of a liquid crystal. In the embodiment, since the number of data drivers can be set to one, it is possible to reduce manufacturing costs, and form a narrow frame.

FIG. 18 shows a configuration example of the liquid crystal display apparatus of the embodiment. This liquid crystal display apparatus includes an image source 101, a display controller 102 incorporating a frame memory 103, a timing controller 104 and a memory control circuit 105, a liquid crystal panel, a drain driver 107 for supplying image data to a pixel of the liquid crystal panel, a gate driver 106, and an illuminator 108.

The embodiment is described by way of example of a driving method employing reverse driving for each column. FIG. 19 shows the driving sequence of the embodiment. A feature is a scanning method, which first selects an n line nearly in a center of a screen, and then alternately selects upper and lower lines. In addition, in the embodiment, excluding a line to be selected first, ½ of a first half of a selection period of one line is overlapped with ½ of a latter half of a selection period of a line selected before. Excluding a line to be selected last, ½ of a latter half thereof is overlapped with ½ of a first half of a selection period of a line to be selected next. The precharge driving described above with reference to the first embodiment is also applied to the embodiment.

Hereinafter, detailed description is made of the driving sequence using precharging applied to the embodiment by referring to FIG. 19. First, in a preset writing period, as in the case of the fourth embodiment, black voltage is written on a full surface of a screen. In a writing period of image data, writing is started from an n-th line, and then alternately in upper and lower directions in the order or an n+1-th line, an n−1-th line, an n+2-th line, and an n−2-th line and, with wiring of a 2n-th line, image data writing and scanning are finished. In a holding period thereafter, a potential applied to a column electrode is set as a black display potential, and crosstalk through an active element or the like is reduced. The potential applied to the column electrode is set as the black display potential. However, there is no limitation in this regard, and a potential having least crosstalk may be set. The illuminator is lit in a last ¼ period of a frame to make an image visible. In an image data transfer method, as in the case of the fourth embodiment, image data sent from the image source is stored in the frame memory, data to be written in a given line is read from an address of the memory, in which the image data of the line has been stored, and transferred to the data driver and, then, in ½ of a latter half of a selection period of the line, the data is outputted from the data driver to a column electrode.

In the driving sequence of the embodiment shown in FIG. 19, a polarity of image data is now discussed by focusing on a given odd-number column. Assuming that image data of a positive polarity is first written in a pixel of an n-th line, in ½ of first half of a selection period of an n+1-th line to be selected next, image data of a positive polarity contributing to displaying of the n-th line is written in the n+1-th line. Then, in ½ of a latter half of the selection period of the n+1-th line, image data of a positive polarity contributing to displaying of a pixel of the n+1-th line is written. Similarly, in ½ of a first half of a selection period of an n−1-th line to be selected next, image data of a positive polarity contributing to displaying of the n+1-th line is written. Then, in ½ of a latter half of the selection period of the n−1-th line, image data of a positive polarity contributing to displaying of the n−1-th line is written. Similarly thereafter, in a pixel of a given odd column, in ½ of a first half of a selection period, since a voltage of a similar polarity can be charged to the pixel beforehand by image data of a line selected one before, image data contributing to displaying can be easily written in ½ of a latter half of the selection period. On the other hand, for an even column, image data contributing to displaying can be easily written by a similar principle except for the fact that a polarity of image data of an odd column is reversed, and image data of a negative polarity is written.

Needless to say, an example of selecting lines one by one without using precharging can also be employed, which is considered as one embodiment of a driving system for alternately selecting lines in upper and lower directions. When high-speed writing is necessary depending on use of the liquid crystal display apparatus, precharging may be carried out by overlapping a selection period with another.

In the embodiment, two lines are simultaneously selected by overlapping ½ of a selection period with that of another. However, three lines may be simultaneously selected by overlapping ⅔ of a latter half of a line selected one before. Especially, in a preset writing period, since scanning must be performed within a shorter period, an overlapped period is made longer.

According to the embodiment, by alternately selecting the lines almost from the center of the screen in upper and lower directions, scanning in both upper and lower directions can be performed even by one data driver. Even when luminance inclination occurs because of an optical response of a liquid crystal, good motion image displaying can be carried out without any reductions in luminance of a center area of the screen, in which a sight line concentrates most. Moreover, since writing of image data contributing to displaying can be carried out in substantially ½ of the selection period by overlapping half of the selection period with the selection period of a line selected one before, it is possible to perform writing at a high speed equal to that of the example of selecting two lines simultaneously by using the two data drivers.

Sixth Embodiment

Figure 21:
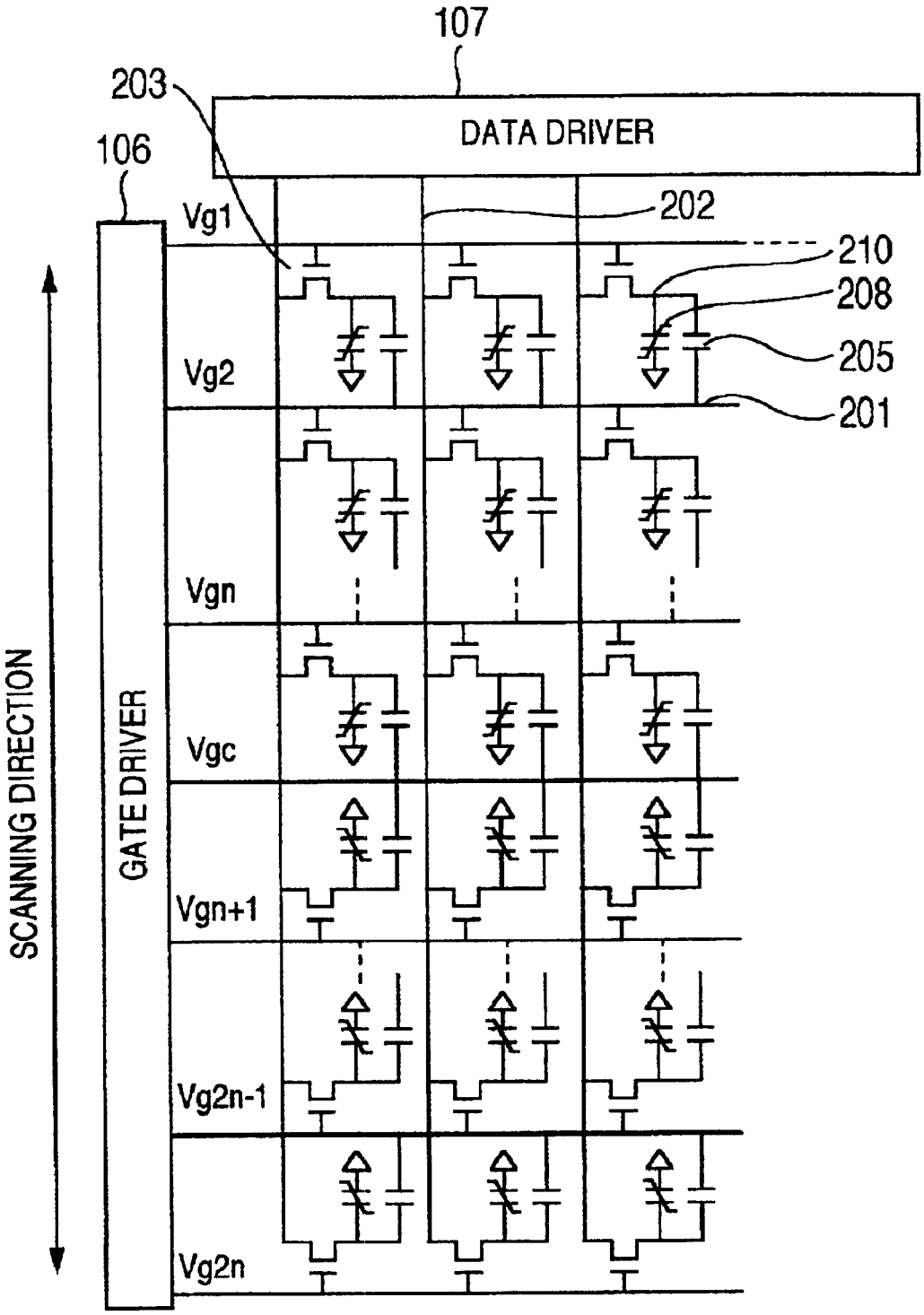
FIG. 21 is a view showing an equivalent circuit according to a sixth embodiment of the present invention.

Next, description will be made of a sixth embodiment by referring to FIGS. 21 and 22.

As a technology for increasing a numerical aperture of a display unit, there is available a method, which uses an unselection period potential of a line wiring 201 of a line finished for data image writing as a reference potential of a holding capacitor 205, without using a reference potential electrode of the holding capacitor 205 of a liquid crystal. By using this method, a portion shutting off a transmitted light is reduced by an amount equivalent to the unnecessary potential electrode of the holding capacitor 205. Accordingly, a numerical aperture can be increased.

In the scanning method of each of the fourth and fifth embodiments, a scanning direction is reversed on the screen center as a boundary. Thus, to use the unselection period potential of a line wiring 201 of a line finished for image data writing as a reference potential of the holding capacitor 205, an equivalent circuit of a pixel in a panel becomes similar to that of FIG. 21. In each of upper and lower screen areas the screen center as a boundary, for a reference potential of a given line, an unselection period potential of the line wiring 201 of a line selected one before is used. Scanning directions are made opposite in upper and lower directions with the screen center as a boundary. In the screen center as a boundary, a holding capacitor reference potential electrode 206 is provided for always supplying a potential of the unselection period of the line wiring 201.

Figure 22:
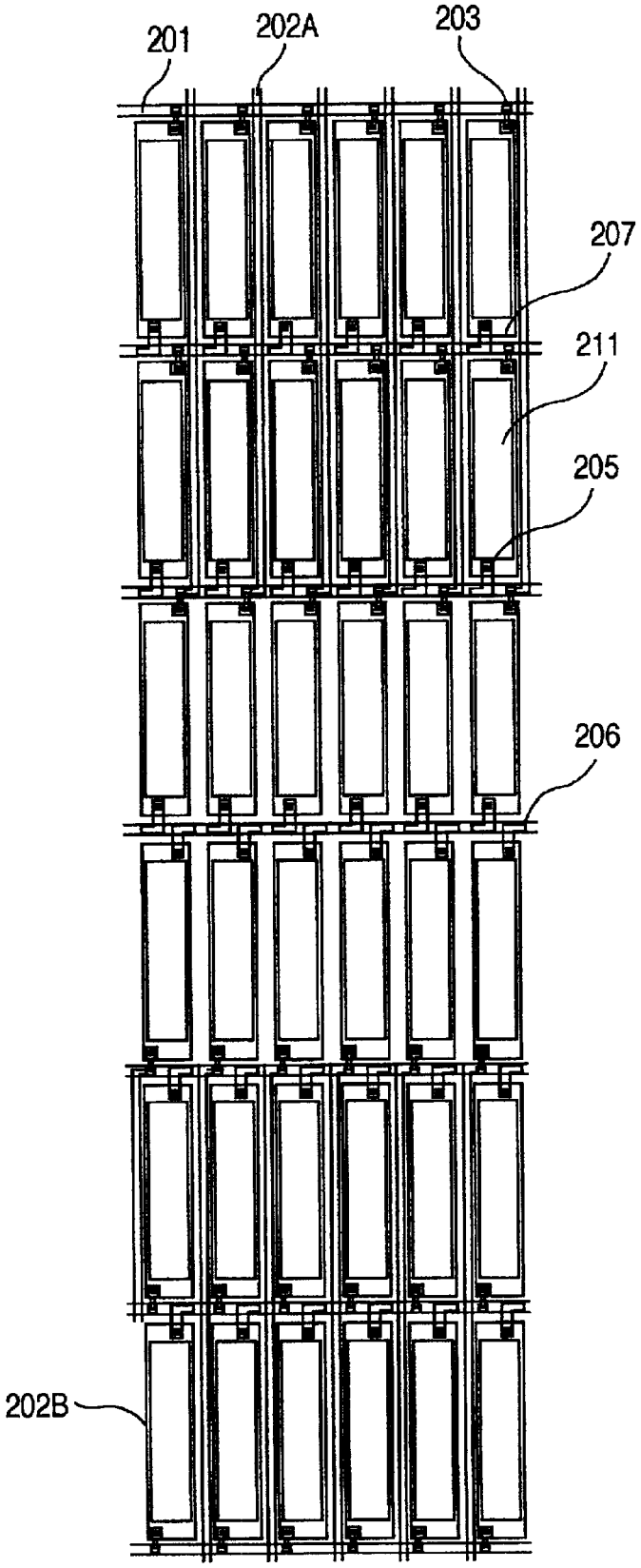
FIG. 22 is a view showing an example of a pixel structure of the sixth embodiment of the invention.

FIG. 22 shows a pixel structure example in the case of a twisted nematic system according to the embodiment. This pixel structure includes a column wiring 202 for supplying image data to an active element 203 controlled to be ON/OFF by a potential of the line wiring 201 and to the pixel, a transparent electrode 207 for applying a voltage to a liquid crystal and taking out a transmitted light to the outside, and a not-shown transparent electrode provided in an opposite side for supplying a reference potential of a voltage applied to the liquid crystal. In a pixel other than a pixel as a boundary, a line wiring 201 of a line selected one before in each screen area, and a holding capacitor 205 are formed. In the pixel as a boundary, a holding capacitor reference potential electrode 206 provided in the boundary and a holding capacitor 205 are formed.

On the electrode 206 for deciding a reference potential of the holding capacitor, a load twice as large as a load on the other line wiring 201 is applied because of the capacitor formed with the pixel as a boundary, and disadvantageous signal delay may occur. However, since a column wiring 202 located in a horizontal direction of the other pixel is not present in the pixel as a boundary, a load is accordingly reduced, and thus signal delay can be reduced. Moreover, the reference potential electrode has a wiring width equal to that of the other line wiring 201, and a light shielding portion of the pixel as a boundary is equal to that of the other pixel. Therefore, there is no discontinuity in the boundary, preventing any display failures.

Seventh Embodiment

Figure 23:
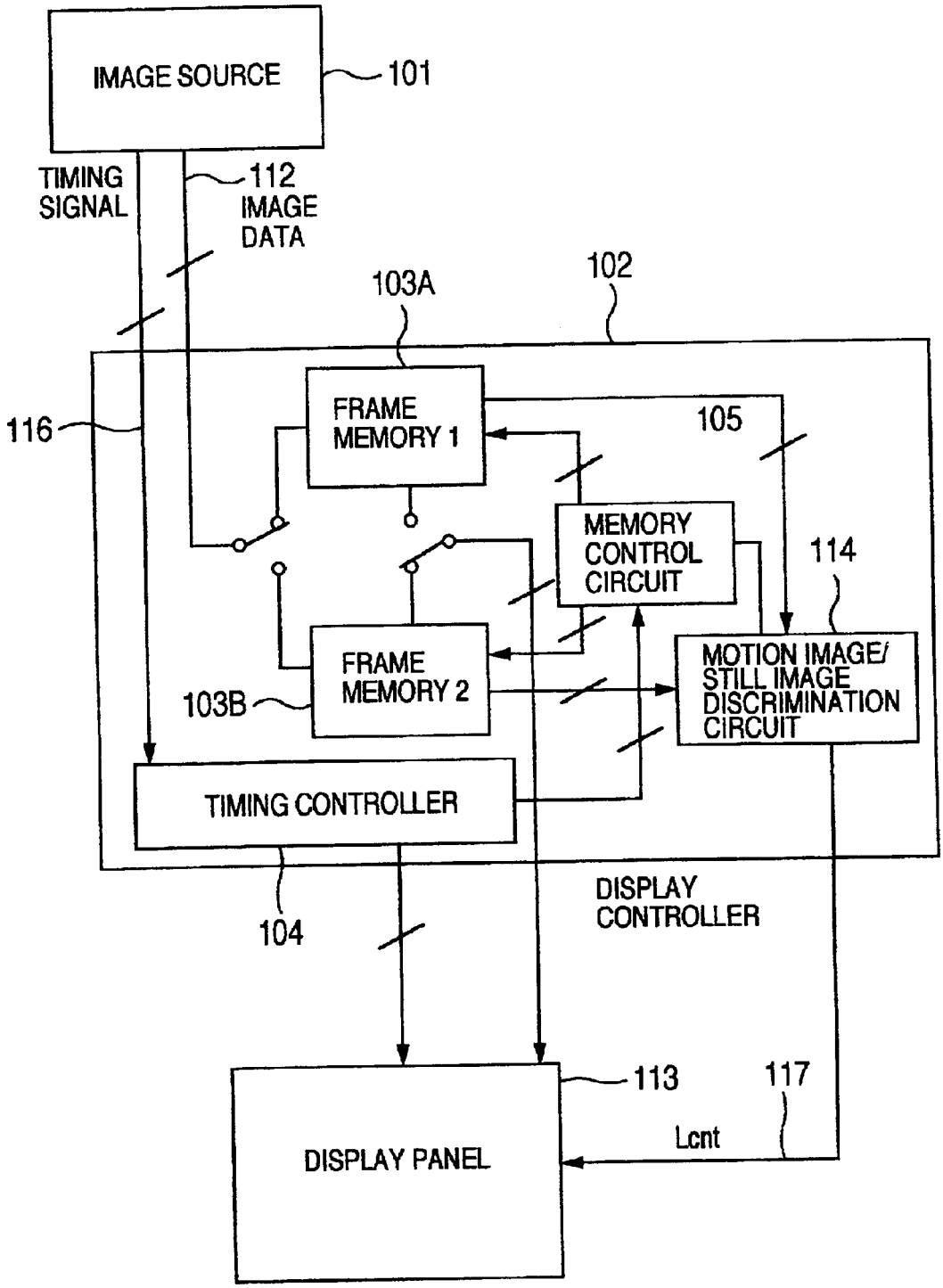
FIG. 23 is a block diagram showing a configuration of a display controller according to a seventh embodiment of the present invention.

Next, description is made of a seventh embodiment by referring to FIG. 23.

In each of the fourth to sixth embodiments, the illuminator 108 is intermittently lit. However, the intermittent lighting of the illuminator 108 is for the purpose of reducing blurring of a motion image, and it is not necessary to intermittently light the illuminator 108 during displaying of a still image. Thus, a feature of the embodiment is that a switch is provided for switching a lighting timing of an illuminator 108 between a motion image and a still image.

FIG. 23 shows a configuration of a display controller 102 of the embodiment. The embodiment is different from the fourth and fifth embodiments in that two frame memories 103 capable of storing image data of one screen are provided to discriminate a motion image and a still image from each other, and a motion image/still image discrimination circuit is provided. For a display panel, one is selected from those of the fourth and fifth embodiments. In the display controller 102, frame memories A and 103A, and frame memories B and 103B are provided. Image data sent from an image source 101 is first stored in the frame memories A and 103A, and then transferred to the frame memories B and 103B. At this time, next image data is stored in the frame memories A and 103A. The motion image/still image discrimination circuit compares memory addresses for storing image data written in the same pixels of screens of the frame memories A and 103A and the frame memories B and 103B with each other, and can determine still image when image data are similar, and a motion image when different.

By using the motion image/still image discrimination circuit to change a lighting timing of the illuminator 108 between a motion image and a still image, it is possible to display a motion image of little blurring, and a still image having uniform luminance in the screen.

In this case, however, if even one of image data written in the same pixels of the frame memories A and 103A, and the frame memories B and 103B is different, determining a motion image, for example when the system is used as a monitor of a personal computer, in work on a normally still screen such as document formation, a lighting timing of the illuminator is changed even by a movement of a mouse, causing a change in luminance of the screen.

Thus, certain specifications are set for discrimination between a motion image and a still image. For example, if a current image and an image of a next frame are different from each other by 30% or more on the screen, motion image displaying is determined, and a still image less than 30%. In this way, in work on a normally still screen, a lighting period of the illuminator for motion image displaying is never set. In addition, when a motion image is displayed in a narrow area of less than 30%, no conspicuous blurring of the motion image is detected, and it is not necessary to intermittently light the illuminator. Needless to say, a numeral 30% varies depending on use, and it is not limited in any way.

Alternatively, a method of switching between motion image displaying and still image displaying by software may be used. That is, in use as a monitor of a personal computer, the illuminator may be intermittently lit when motion image display software is actuated.

When a lighting timing of the illuminator is switched between a motion image and a still image as in the case of the embodiment, if emission luminance of the illuminator is always constant, luminance of the screen is changed during switching between the motion image and the still image, and flickering occurs on the screen when the motion and still images are frequently switched, for example on a TV screen. Thus, an arrangement can be made for adjusting a tube current of a lamp of the illuminator in order to prevent any changes in average luminance of the screen between the motion and still images.

Eighth Embodiment

Figure 24:
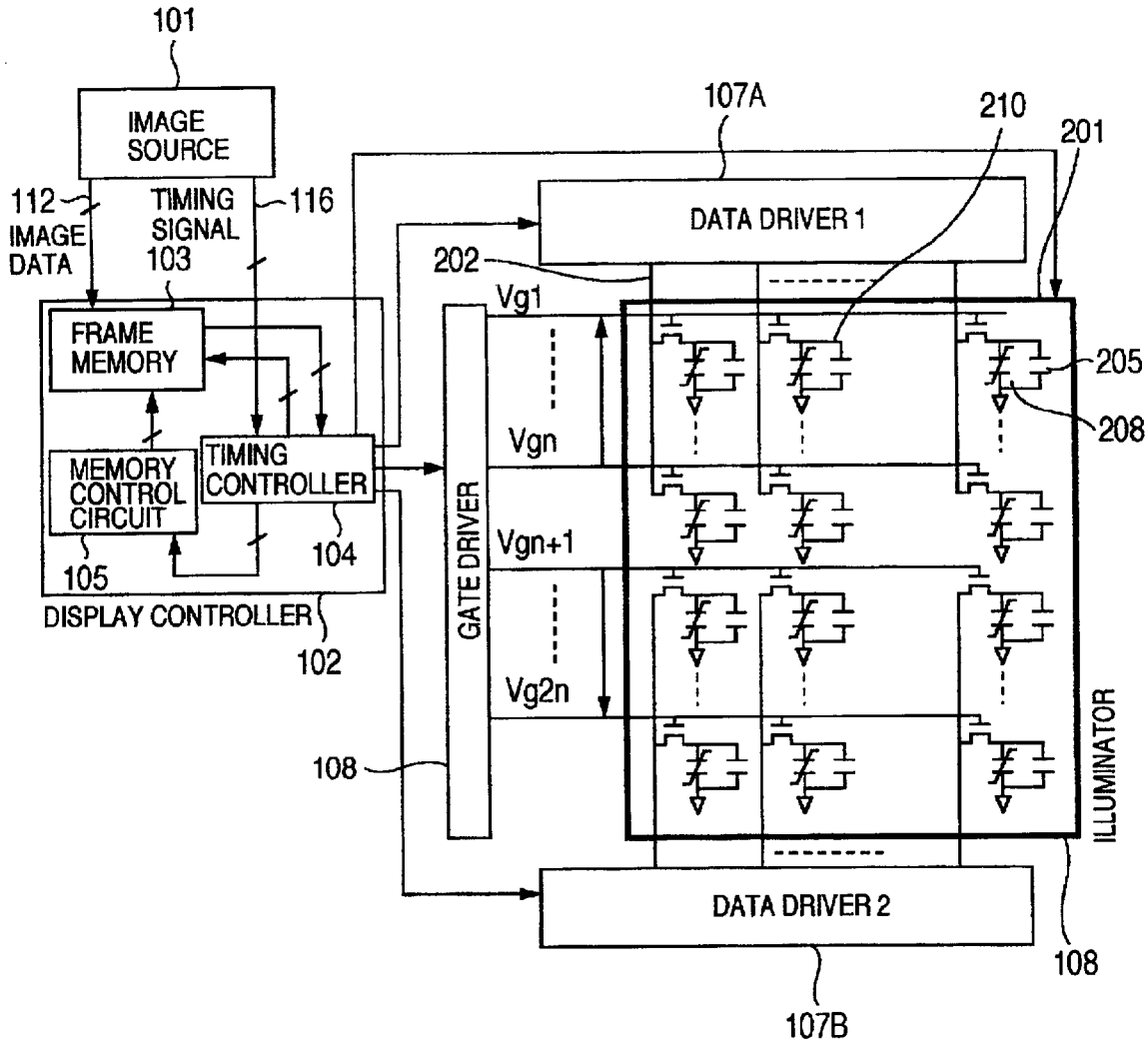
FIG. 24 is a configuration view of an eighth embodiment of the present invention.
Figure 25:
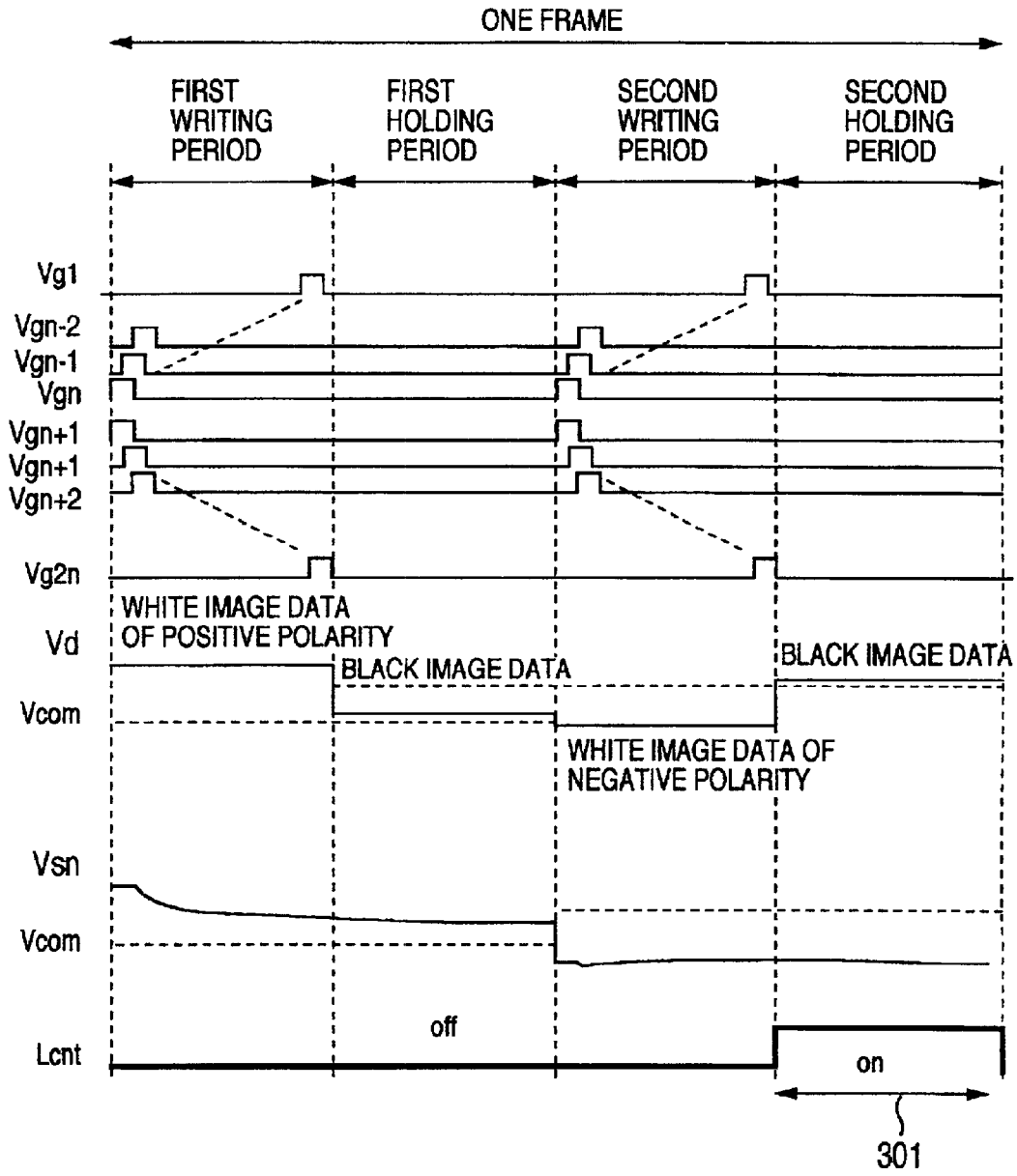
FIG. 25 is a view showing a driving sequence according to the eight embodiment of the present invention.
Figure 26:
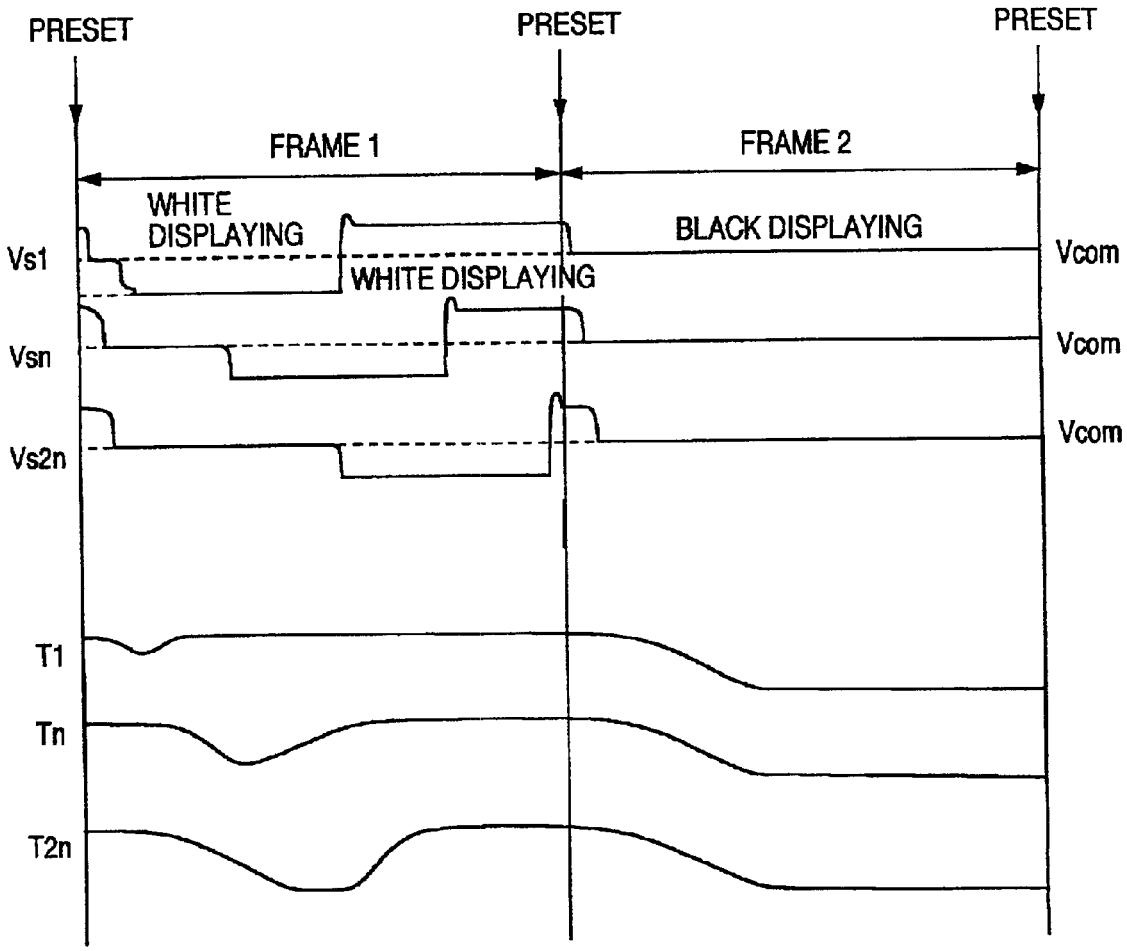
FIG. 26 is an explanatory view showing a display characteristic in a conventional precharging operation method.

Next, detailed description is made of an eighth embodiment by referring to FIGS. 24 and 25. The embodiment presents a method of writing image data at a high speed, which is essential for a liquid crystal display apparatus capable of making an image visible by intermittently lighting an illuminator, and provides a scanning method capable of preventing a great loss of visibility even when luminance inclination occurs following an optical response of a liquid crystal.

In the embodiment, a driving method is used, which performs scanning from a screen center in both upper and lower directions, and simultaneously writes image data in two lines. Furthermore, in an area of the same scanning direction, precharging is used. FIG. 24 shows a configuration example of the embodiment. A configuration substantially similar to that used in the fourth embodiment can be used, and achieved only by changing a logical circuitry in a display controller 102.

FIG. 25 shows a display sequence of the embodiment. Here, if one selection period is fixed, and a writing speed of the conventional liquid crystal display apparatus using a period of substantially one frame for one round of scanning is called monoploid writing, since in the embodiment, a line of an area above the screen center scanned in an upper direction, and a line below the screen center scanned in a lower direction are simultaneously selected, one round of scanning can be finished within a period half of one frame. That is, double-speed writing is possible. In addition, because of the use of precharging, writing of image data contributing to image displaying is ½ of a latter half of a selection period, and writing of one pixel is substantially half of the section period. Accordingly, one round of scanning can be finished within ¼ of one frame. In other words, writing at a high speed faster by four times is possible in the embodiment. For example, if a liquid crystal display panel having a wiring capacity of 400 pF, and wiring resistance of 3 kΩ is used as in the case of the first embodiment, a charging time constant is 1.2 micro-sec., but 10 micro-sec., half of about 20 micro-sec., as a general line selection period of the liquid crystal display apparatus having 768 lines, is larger than $4\tau$ to $8\tau$ for sufficient writing. Thus, it is possible to obtain a good writing characteristic even when a substantially selection period is halved by using precharging.

FIG. 25 shows a sequence of displaying white on a full surface of a screen. In a first writing period, white image data of positive polarities are written in all pixels, scanning is stopped in a first holding period, and a column wiring is fixed at black image data potential. In a second writing period, white image data of negative polarities are written in all the pixels, scanning is stopped in a second holding period, and the column wiring is fixed at a black image data potential. Then, after fluctuation in a voltage applied to a liquid crystal by crosstalk is suppressed, the illuminator is lit, and an image is made visible.

According to the embodiment, by writing image data of a positive polarity in the first writing period, and image data similar but reverse in polarity from the first writing period in the second writing period, AC setting of a voltage applied to a liquid crystal ion one frame in all the pixels is achieved. Moreover, since one round of scanning can be finished within ¼ of one frame, even in a very last line to be scanned in the scanning period, there is a period of ½ of one frame from writing to lighting of the illuminator. Thus, by using a liquid crystal, an optical response thereof being finished within ½ of one frame, no luminance inclination appears following the optical response of the liquid crystal. Even if a response of the liquid crystal requires a period of ½ frame or more, shorter a period from the writing to the lighting of the illuminator, closer to upper and lower ends of the screen. Thus, it is possible to prevent any great reductions in visibility.

According to the embodiment of the present invention, regarding a liquid crystal display apparatus combining intermittent lighting of an illuminator with application of present voltage, it is possible to provide a liquid crystal display apparatus capable of performing motion image displaying without any residual images, flickers, crosstalk or blurring, and also high-definition motion image displaying.

According to the present invention, regarding a liquid crystal display apparatus using intermittent lighting of an illuminator, it is possible to provide a liquid crystal display apparatus having luminance higher in a center area, in which a viewpoint most easily concentrates in a screen, and no luminance differences in a scanning boundary.

It should be further understood by those skilled in the art that the foregoing description has been made on embodiments of the invention and that various changes and modifications may be made in the invention without departing from the spirit of the invention and the scope of the appended claims.

What is claimed is:

1. A liquid crystal display apparatus comprising:

a liquid crystal layer held between a pair of substrates, at least one thereof being transparent;

a plurality of line wirings and a plurality of column wirings disposed on one of the substrates; and first active elements in intersections of the plurality of line wirings and the plurality of column wirings, wherein an image is displayed by writing image data in pixels disposed in a matrix form through the first active elements, preset writing is executed on a full surface of a screen in synchronization with a frame signal, the image is made visible by intermittently lighting an illuminator, both polarities, positive and negative, are displayed in one frame period, a period obtained by subtracting a preset displaying period of each line from the one frame period is substantially equally distributed between positive polarity displaying and negative polarity displaying of one line, and then displaying is carried out.

2. A liquid crystal display apparatus according to claim 1, wherein the first holding period is set to be substantially zero.

3. A liquid crystal display apparatus according to claim 1, wherein in each writing period, writing polarities are similar to each other on a full surface of the screen.

4. A liquid crystal display apparatus according to claim 3, wherein a potential of a common electrode as a reference for a potential a pixel wiring is varied between the first and second writing periods.

5. A liquid crystal display apparatus according to claim 3, wherein a black writing voltage of the second writing voltage is equal to/lower than a black writing voltage of the first writing period.

6. A liquid crystal display apparatus according to claim 1, wherein a second holding period and a lighting period of the illuminator are substantially equal to each other.

7. A liquid crystal display apparatus according to claim 1, wherein at least in a lighting period of the illuminator, all the column wirings are fixed to predetermined potentials.

8. A liquid crystal display apparatus according to claim 7, wherein each of the predetermined potentials is one selected from a black-displaying potential and a displaying potential of a slow optical response speed.

9. A liquid crystal display apparatus according to claim 1, wherein scanning is started from one line or a pair of adjacent lines, one or more lines being present in a screen, and the scanning is carried out in both upper and lower directions with the one line or the pair of adjacent lines set as a reference.

10. A liquid crystal display apparatus according to claim 1, wherein a plurality of lines are simultaneously selected, and the same data is written in the plurality of lines.

11. A liquid crystal display apparatus according to claim 10, wherein the number of simultaneously selected lines is two, and two starting lines making a pair are alternated with other two to be odd and even lines for each frame.

12. A liquid crystal display apparatus according to claim 11, wherein image data written in the two lines making a pair takes an average value of image signals of the two lines.

13. A liquid crystal display apparatus according to claim 11, wherein for the image data written in the two lines making a pair, selection of only image data of odd lines and selection of image data of even lines in a continuous frame are alternately repeated.

14. A liquid crystal display apparatus according to claim 1, further comprising a switch for discriminating motion and still images from each other, and a driving method of the illuminator is divided between the motion and still images.

15. A liquid crystal display apparatus according to claim 14, wherein the illuminator is flashed during displaying of the motion image, and always lit during displaying of the still image.

16. A liquid crystal display apparatus according to claim 15, wherein a switch is provided for dividing luminance of the illuminator between the displaying of the motion image and the displaying of the still image.

17. A liquid crystal display apparatus according to claim 1, wherein precharging is carried out by making conductive (ON state) the first active elements of m lines before a line selected for writing the image data.

18. A liquid crystal display apparatus according to claim 1, wherein line wirings excluding the line selected for writing the image data and precharged lines are set in high resistance states.

19. A liquid crystal display apparatus according to claim 1, wherein a common electrode for establishing a potential of writing in the pixel is disposed in the pixel, and connected to common wirings for supplying a potential to the common electrode, and a high resistance state is set between those among the common wirings not related to at least the line selected for writing the image data and the precharged lines, and the common electrode receiving the potential from the common wirings.

20. A liquid crystal display apparatus according to claim 19, wherein a second active element is disposed between the common wiring and the common electrode, and the common wiring or the common electrode is connected to source and drain terminals of the second active element.

21. A liquid crystal display apparatus according to claim 20, wherein a gate electrode of the active element is connected to a gate wiring of its own pixel.

22. A liquid crystal display apparatus according to claim 21, wherein the gate electrode of the active element is connected to a gate wiring of a next stage adjacent in a scanning direction.

23. A liquid crystal display apparatus according to claim 1, wherein motion and still images are first discriminated from each other, for the motion image, the same image data of a plurality of lines is written, and for the still image, image data is directly written.

24. A liquid crystal display apparatus according to claim 23, wherein the number of lines for wiring the same image data of the motion image is two, and two starting lines making a pair are alternated with other two to be odd lines and even lines for each frame.

25. A liquid crystal display apparatus according to claim 24, wherein among the image data of the two lines making a pair, image data of a line, from which writing is started before the other lines, is corrected based on a predetermined relation.

26. A liquid crystal display apparatus according to claim 25, wherein all the image data of the still image are corrected by a predetermined relation based on a difference in luminance with a peripheral pixel.

27. A liquid crystal display apparatus according to claim 1, wherein a writing polarity is set in order to set a potential difference between a high voltage Vgh and a voltage Vdbk2 for black displaying during gate writing in the second writing period larger than a potential difference between a high voltage Vgh and a voltage Vdbk1 for black displaying during gate writing in the first writing period.

28. A liquid crystal display apparatus according to claim 1, wherein a display mode of the liquid crystal is an in-plane switching mode or a normally black mode, on which displaying is black when no voltage is applied to the liquid crystal.

29. A liquid crystal display apparatus according to claim 1, wherein the first active element for writing in the pixel is a high-mobility active element.

30. A liquid crystal display apparatus according to claim 29, the high-mobility active element is a polycrystal thin film transistor or a single crystal silicon transistor.

31. A liquid crystal display apparatus according to claim 1, wherein the common wirings are disposed in a meshed form.

32. A liquid crystal display apparatus according to claim 1, wherein the common wirings are disposed in parallel with the column wirings.

33. A liquid crystal display apparatus according to claim 1, wherein the illuminator uses a high-speed response light source.

34. A liquid crystal display apparatus according to claim 33, wherein the high-speed response light source is one selected from, or a combination of a light source using a field emission electron source (FED: field emission display), a light source of a plasma using emission type, a high-speed response fluorescent tube.

35. A liquid crystal display apparatus comprising:

a liquid crystal layer held between a pair of transparent substrates, at least one thereof being transparent;

a plurality of line wirings and a plurality of column wirings disposed on one of the substrates; and first active elements in intersections of the pluralities of line and column wirings, wherein an image is displayed by writing image data in pixels disposed in a matrix form through the first active elements, preset writing is executed on a full surface of a screen in synchronization with a frame signal, the image is made visible by intermittently lighting an illuminator, one frame period is divided into a first writing period, a first holding period, a second writing period, a second holding period, and a reset writing period, the liquid crystal display apparatus is driven in this sequence, voltage polarities of the first and second writing periods are reversed, and the second writing period is set to be about ½ of the first writing period.

36. A liquid crystal display apparatus according to claim 35, wherein the second writing period is started after a passage of about ½ of a period obtained by subtracting a presetting period from one frame period.

37. A liquid crystal display apparatus according to claim 35, wherein the present writing is black writing.

38. A liquid crystal display apparatus comprising:

a liquid crystal layer held between a pair of substrates, at least one thereof being transparent;

a plurality of line wirings and a plurality of column wirings disposed on one of the substrates; and first active elements in intersections of the pluralities of line and column wirings, wherein an image is displayed by writing image data in pixels disposed in a matrix form through the first active elements, the image is made visible by intermittently lighting an illuminator, division is made into the number 2 n of subframes in one frame period, the same image data is subjected to write-scanning while a writing polarity is reversed for each of the subframes, and the illuminator is intermittently lit in a predetermined period of a latter half of one frame.

39. A liquid crystal display apparatus adapted to display both polarities, positive and negative, in one frame period, distribute a residual period obtained from subtracting a preset displaying period of each line from one frame period substantially equally to positive and negative polarity displayings of each line, and then carry out displaying.

40. A liquid crystal display apparatus adapted to divide one frame period into a preset writing period, a first writing period, a first holding period, a second writing period, and a second holding period, to be driven in this sequence, reverse writing voltage polarities of the first and second writing periods, and set the second writing period to be about ½ of the first writing period.

* * * * *